US009272814B2

(12) United States Patent
Carver et al.

(10) Patent No.: US 9,272,814 B2
(45) Date of Patent: Mar. 1, 2016

(54) BULK MATERIAL CONTAINER

(71) Applicant: R3 Composites, Inc., Muscatine, IA (US)

(72) Inventors: Roy J. Carver, Muscatine, IA (US); David J. Burken, Blue Grass, IA (US); Mark A. Post, Muscatine, IA (US); Aron Rutin, Milan, IL (US); Brig W. Vanderwoude, Milan, IL (US)

(73) Assignee: R3 Composites, Inc., Muscatine, IA (US)

( * ) Notice: Subject to any disclaimer, the term of this patent is extended or adjusted under 35 U.S.C. 154(b) by 0 days.

(21) Appl. No.: 13/765,027

(22) Filed: Feb. 12, 2013

(65) Prior Publication Data

US 2013/0221003 A1 Aug. 29, 2013

Related U.S. Application Data

(63) Continuation of application No. 12/981,015, filed on Dec. 29, 2010, now Pat. No. 8,474,622.

(60) Provisional application No. 61/290,833, filed on Dec. 29, 2009.

(51) Int. Cl.
*B65D 21/00* (2006.01)
*B65D 21/04* (2006.01)
(Continued)

(52) U.S. Cl.
CPC ..... *B65D 21/0217* (2013.01); *B65D 11/1873* (2013.01); *B65D 19/0018* (2013.01);
(Continued)

(58) Field of Classification Search
USPC ..... 206/519, 503, 508; 220/625, 656
See application file for complete search history.

(56) References Cited

U.S. PATENT DOCUMENTS 2,191,291 A * 2/1940 Smith ..... 229/117.16
2,665,047 A * 1/1954 Belsinger ..... 229/125.21
(Continued)

FOREIGN PATENT DOCUMENTS

CN 1041139 A 4/1990
CN 1317435 A 10/2001
(Continued)

OTHER PUBLICATIONS

European Patent Office, Communication with Extended search report in in Application No. 10844285.6 on Feb. 14, 2014 (10 pages).
(Continued)

*Primary Examiner* — Mickey Yu
*Assistant Examiner* — Gideon Weinerth
(74) *Attorney, Agent, or Firm* — McAndrews, Held & Malloy, Ltd.

(57) ABSTRACT

A bulk material container and method for its use is provided. In one or more embodiments, the bulk material container includes: a lid with a lid reinforcement frame positioned substantially at least around the perimeter of said lid, a vertical stop on the exterior of the walls of said container that contacts a projection from an interior wall of said container when one of said bulk material containers is stacked in another, a modular design in which the walls and base of the bulk material container are detachable and replaceable, a stiffening ring positioned around the perimeter of the container walls near their vertical top, and a lid having a lateral motion restraining a system to restrain the lateral motion of one container stacked on another.

20 Claims, 19 Drawing Sheets

(51) Int. Cl.

| | |
|---|---|
| ***B65D 21/02*** | (2006.01) |
| ***B65D 6/24*** | (2006.01) |
| ***B65D 19/00*** | (2006.01) |

(52) U.S. Cl.

CPC .. *B65D21/0233* (2013.01); *B65D 2519/00034* (2013.01); *B65D 2519/00069* (2013.01); *B65D 2519/0087* (2013.01); *B65D 2519/0094* (2013.01); *B65D 2519/00174* (2013.01); *B65D 2519/00208* (2013.01); *B65D 2519/00268* (2013.01); *B65D 2519/00288* (2013.01); *B65D 2519/00318* (2013.01); *B65D 2519/00338* (2013.01); *B65D 2519/00422* (2013.01); *B65D 2519/00457* (2013.01); *B65D 2519/00497* (2013.01); *B65D 2519/00582* (2013.01); *B65D 2519/00611* (2013.01); *B65D 2519/00641* (2013.01); *B65D 2519/00711* (2013.01); *B65D 2519/00786* (2013.01); *B65D 2519/00796* (2013.01); *B65D 2519/00805* (2013.01)

(56) References Cited

U.S. PATENT DOCUMENTS

| | | | | | |
|---|---|---|---|---|---|
| 2,994,457 | A | * | 8/1961 | Fornas | 206/507 |
| 3,147,882 | A | * | 9/1964 | Waters | 206/507 |
| 3,172,562 | A | * | 3/1965 | Nascher et al. | 206/509 |
| 3,374,915 | A | | 3/1968 | Verhein | |
| 3,403,814 | A | * | 10/1968 | Asenbauer | 206/509 |
| 3,434,625 | A | * | 3/1969 | Embry, Jr. | 220/495.06 |
| 3,759,416 | A | * | 9/1973 | Constantine | 206/505 |
| 3,987,829 | A | * | 10/1976 | Leone | B65D 1/22 220/675 |
| 4,042,111 | A | * | 8/1977 | Smith | 206/508 |
| D248,015 | S | * | 5/1978 | Smith | D3/294 |
| 4,673,087 | A | * | 6/1987 | Webb | 206/600 |
| 4,720,020 | A | * | 1/1988 | Su | 220/6 |
| 4,756,420 | A | * | 7/1988 | Deaton | 206/514 |
| 4,848,605 | A | * | 7/1989 | Wise | 222/608 |
| 4,863,056 | A | | 9/1989 | Inayama | |
| 4,903,853 | A | * | 2/1990 | Lin | 220/6 |
| 5,033,669 | A | * | 7/1991 | Federico | 229/198.1 |
| 5,183,180 | A | * | 2/1993 | Hawkins | B65F 1/122 220/669 |
| 5,190,179 | A | | 3/1993 | Richter | |
| 5,253,763 | A | * | 10/1993 | Kirkley et al. | 206/600 |
| D351,063 | S | * | 10/1994 | Fenelon | D3/304 |
| 5,429,261 | A | * | 7/1995 | Machino | 220/7 |
| 5,462,221 | A | * | 10/1995 | Zink et al. | 229/117.16 |
| 5,474,196 | A | * | 12/1995 | Fausel et al. | 220/4.28 |
| 5,638,983 | A | | 6/1997 | Bazany | |
| 5,662,223 | A | | 9/1997 | Sylegaard | |
| 5,680,948 | A | * | 10/1997 | Schmidt et al. | 220/7 |
| 5,743,422 | A | * | 4/1998 | Hale | 220/4.33 |
| 5,826,721 | A | | 10/1998 | Fujimoto | |
| 5,829,595 | A | * | 11/1998 | Brown et al. | 206/600 |
| D414,333 | S | * | 9/1999 | Barber et al. | D3/272 |
| 6,367,630 | B1 | | 4/2002 | Elskamp | |
| 6,401,952 | B1 | * | 6/2002 | Ming | 220/4.09 |
| 6,619,540 | B1 | * | 9/2003 | Bazany | 229/199 |
| 6,669,044 | B2 | | 12/2003 | Murakami | |
| 6,726,045 | B1 | * | 4/2004 | Chen et al. | 220/4.34 |
| D580,170 | S | * | 11/2008 | Klotzman | D3/272 |
| 8,146,224 | B1 | * | 4/2012 | Vroon | 29/401.1 |
| 8,209,916 | B2 | * | 7/2012 | Herron | 52/79.5 |
| 8,235,217 | B2 | * | 8/2012 | Stolzman | 206/600 |
| 8,474,622 | B2 | * | 7/2013 | Carver et al. | 206/519 |
| 8,689,992 | B2 | * | 4/2014 | Anderson | A47C 1/14 217/12 R |
| 2003/0102309 | A1 | * | 6/2003 | Hartwall | B65D 19/18 220/6 |
| 2004/0118725 | A1 | * | 6/2004 | Shuert | B65D 19/0028 206/386 |
| 2005/0061824 | A1 | | 3/2005 | Miller | |
| 2010/0108556 | A1 | * | 5/2010 | Claffy | B65D 11/24 206/508 |
| 2011/0155729 | A1 | * | 6/2011 | Hall | B65D 19/16 220/4.28 |
| 2012/0012493 | A1 | * | 1/2012 | Cleveland et al. | 206/508 |
| 2012/0181214 | A1 | * | 7/2012 | Kernen | B65D 19/04 206/596 |
| 2014/0083896 | A1 | * | 3/2014 | Park | 206/503 |
| 2014/0190861 | A1 | * | 7/2014 | Carrel | A61M 5/002 206/518 |
| 2015/0027917 | A1 | * | 1/2015 | Goddard | B65D 19/12 206/386 |

FOREIGN PATENT DOCUMENTS

| | | | |
|---|---|---|---|
| EP | 1038803 | A1 | 9/2000 |
| JP | 2001-240052 | A | 9/2001 |
| JP | 2003-291962 | A | 10/2003 |

OTHER PUBLICATIONS

State Intellectual Property Office of the People's Republic of China, First Office Action in Application No. 201080064704.5, in Jan. 30, 2014. (21 pages).

PCT, Notification of Transmittal of the International Search Report and the Written Opinion of the International Searching Authority, or the Declaration, in International application No. PCT/US2010/062347, dated May 6, 2011. (17 pages).

State Intellectual Property Office of the People's Republic of China, in Application No. 201080064704.5, dated Oct. 10, 2014 (17 pages).

* cited by examiner

BULK MATERIAL CONTAINER

RELATED APPLICATIONS

This application claims the benefit of U.S. Provisional Application No. 61/290,833 filed Dec. 29, 2009 entitled "Bulk Material Container," which is hereby incorporated by reference in its entirety.

BACKGROUND OF THE INVENTION

The present invention generally relates to bulk material containers.

Prior art bulk material containers have included one or more of the following drawbacks. First, flimsy lids that prevent containers from being stacked on each other. Second, for those containers that are stackable, when empty containers are stacked, the empty containers may damage each other.

Third, different structural forces may act with greater or lesser force at different points in the container. This may lead to an increased risk of failure at certain points of the container's design. Finally, for those containers that are stackable, the stacked container may occasionally undesirably move relative to the container that it had been stacked on.

BRIEF SUMMARY OF THE INVENTION

One or more embodiments of the present invention provide an improved bulk material container and method of use. One or more embodiments include one or more of the following advantages. First, the bulk material container includes: a lid with a lid reinforcement frame positioned substantially at least around the perimeter of said lid so that the lid is more structurally sound and one bulk material container may be stacked on another. Second, a vertical stop on the exterior of the walls of said container that contacts a projection from an interior wall of said container when one of said bulk material containers is stacked in another, so that the based of the interior container does not contact the base of the exterior container, in order to prevent damage. Third, a modular design in which the walls and base of the bulk material container are detachable and replaceable, so that one portion of the container may be removed and replaced if it becomes damaged. Fourth, a stiffening ring positioned around the perimeter of the container walls near their vertical top so that the stiffening ring constrains the outward motion of the container walls. Fifth, a lid having a lateral motion restraining system to restrain the lateral motion of one container stacked on another.

DETAILED DESCRIPTION OF THE INVENTION

Figure 1:
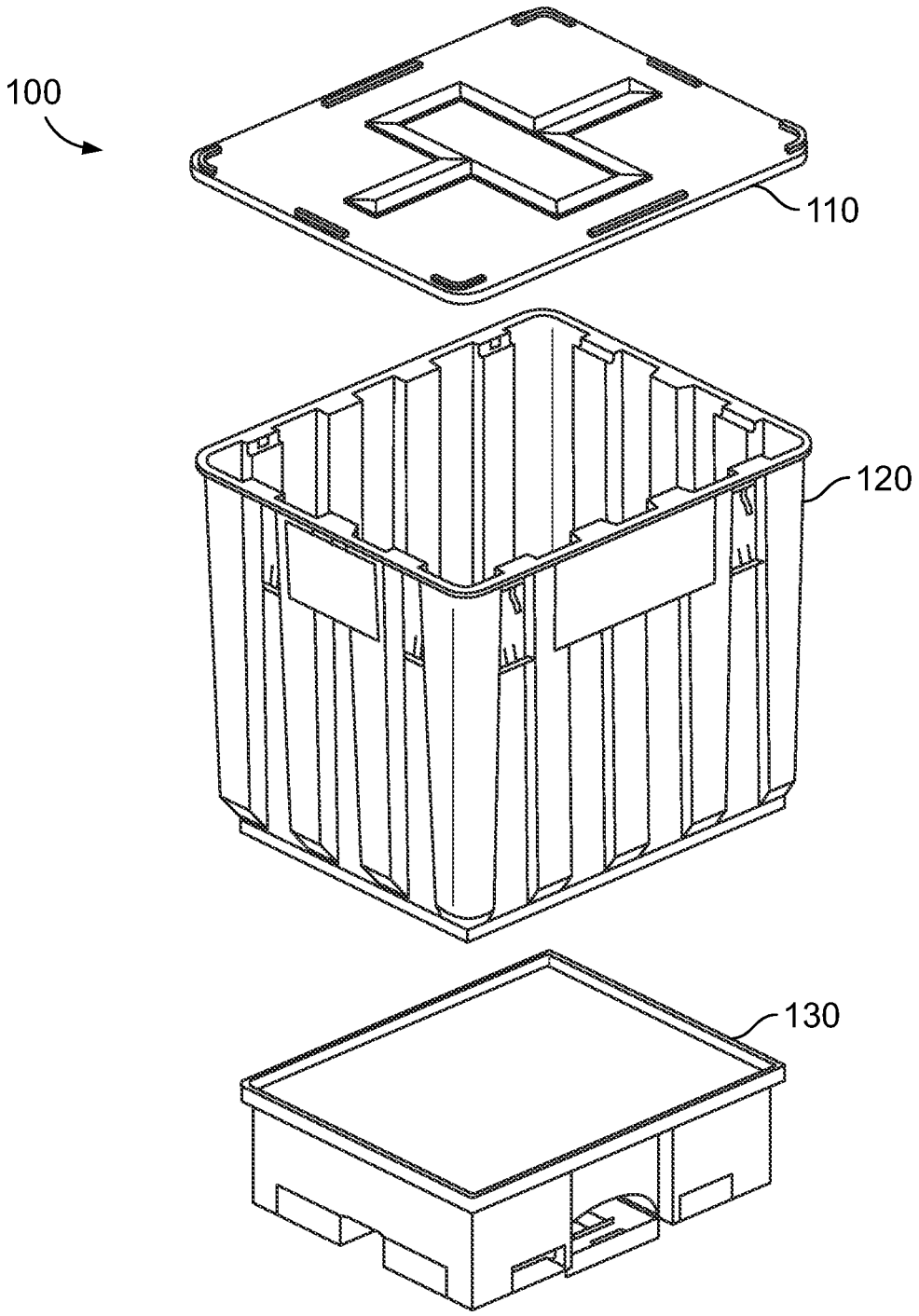
FIG. 1 illustrates an exploded view of a bulk material container 100 according to an embodiment of the present invention.

FIG. 1 illustrates an exploded view of a bulk material container 100 according to an embodiment of the present invention. The bulk material container 100 includes a lid 110, container walls 120, and a hopper base 130.

The container walls 120 are preferably fixed at their bottom extent to the perimeter of the hopper base 130 to form the material-containing portion of the bulk material container 100. The lid 110 may then be installed on the top of the container walls 120 in order to seal the bulk material container 100.

Figure 2:
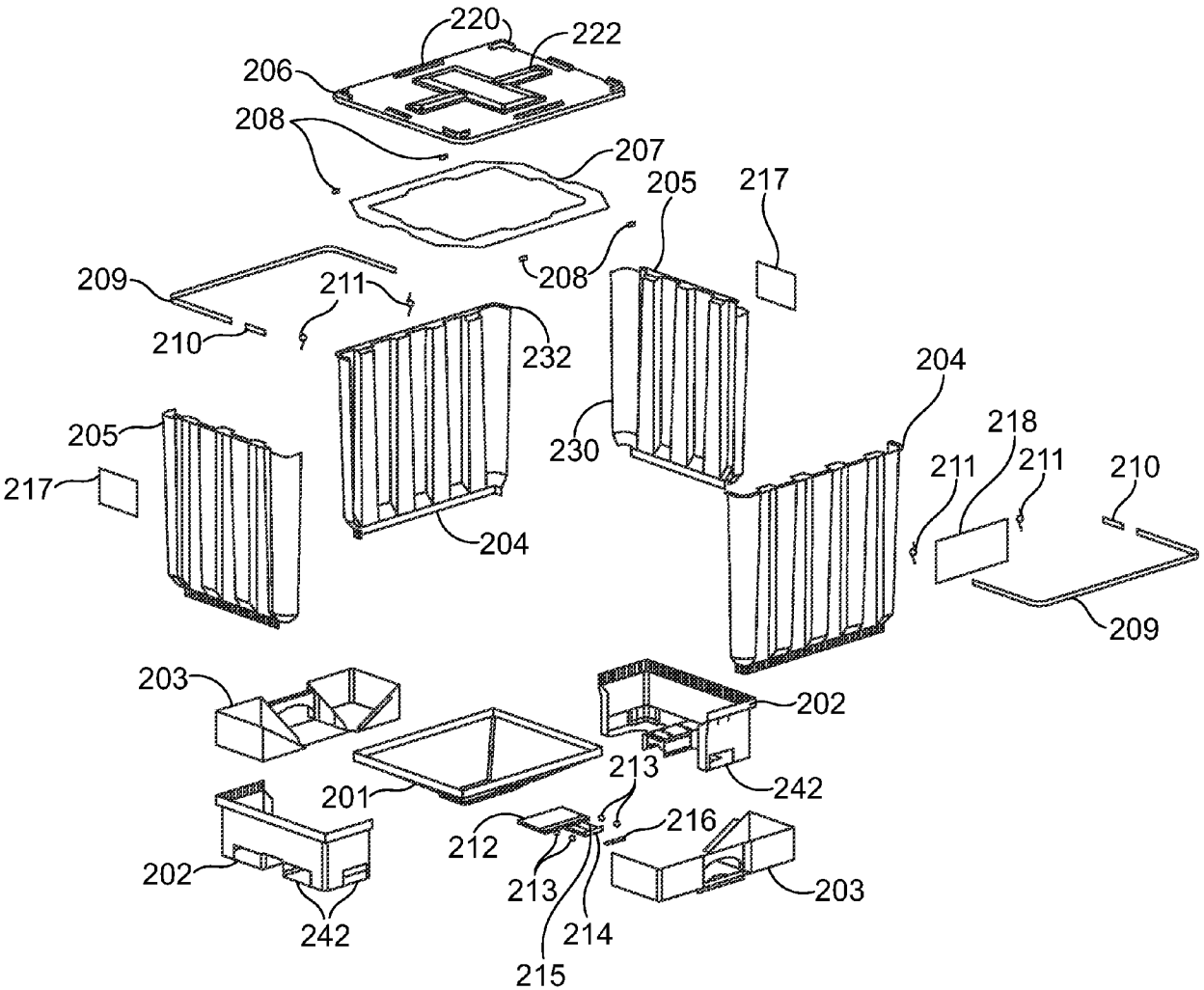
FIG. 2 illustrates an exploded view of the bulk material container of FIG. 1.

FIG. 2 illustrates a more detailed exploded view 200 of the bulk material container 100 of FIG. 1. The bulk material container 100 includes a hopper 201, outer feet 202, inner feet 203, long side walls 204, short side walls 205, a lid 206, a lid frame 207, a lad latch keeper 208, a top tube 209, a tube insert 210, a lid hatch 211, a hopper chute 212, a chute guide 213, a chute lock 214, a washer 215, an open sticker 216, a document pouch 217, and a branding placard 218.

The lid 110 of FIG. 1 includes the lid 206, the lid frame 207, and the lid latch keeper 208 of FIG. 2. The lid frame 207 is preferably constructed of plastic or composite. The lid frame 207 is installed into the bottom of the lid 206 to provide greater structural stability and strength to the lid 206. For example, in the instance wherein the lid 206 is composed of plastic, the lid frame 207 may be composed of a hardened metal and/or plastic element. The lid frame 207 is preferably fixedly installed into the lid 206, for example by providing a structure on the bottom of the lid 206 into which the lid frame is received 207, for example, a molded plastic structure sized to receive and retain the lid frame 207. The additional structural strength provided by the lid frame 206 may be especially desirable when additional containers are stacked on top of the lid 101.

The lid latch keeper 208 operates in cooperation with the lid latch 211 (as further described below) in order to latch the lid 206 onto the container walls 120.

Additionally, as shown in FIG. 2, the lid 206 includes several lateral motion restraints including exterior lateral motion restraints 220 and interior lateral motion restraints 222. The exterior lateral motion restraints 220 are positioned so that the distance between exterior lateral motion restraints 220 on opposite sides of the lid 206 is sufficient to receive the exterior of the base of a hopper that is stacked on top of the lid 206. When a hopper is stacked on top of the lid 206, the exterior lateral motion restrained 220 interact with the exterior of the bottom edges of the hopper so that lateral motion of the hopper relative to the lid is restrained. Consequently, the hopper stacked on top of the lid 206 is less likely to slide off of the lid 206.

Additionally, the lid 206 includes interior lateral motion restraints 222. The interior lateral motion restraints 222 are sized and positioned so that they cooperate with the structure of the base of a hopper that is stacked on top of the lid 206. Similarly to the exterior lateral motion restraints 220, when a hopper is stacked on top of the lid 206, the interior lateral motion restraints 220 interact or contact the bottom edges of hopper so that the lateral motion of the hopper relative to the lid 206 is restrained. Thus, the hopper stacked on top of the lid 206 is less likely to slide off of the lid 206.

Returning now to FIG. 2, the container walls 120 of FIG. 1 include the long side walls 204, short side walls 205, top tube 209, tube insert 210, lid hatch 211, document pouch 217, and branding placard 218 of FIG. 2.

Both the long side walls 204 and short side walls 205 are constructed so that the outer surfaces of the walls 204, 205 have an alternating series of projections and recesses extending from near the bottom of the wall to the top of the wall. Additionally, the inner surfaces of the walls 204, 205 also have an alternating series of projections and recesses extending from near the bottom of the wall to the top of the wall. In operation, the series of projections and recesses on the interior of the walls 204, 205 is sized to receive the exterior projections and recesses from another bulk container that is introduced into the interior of the bulk container 100.

Figure 3:
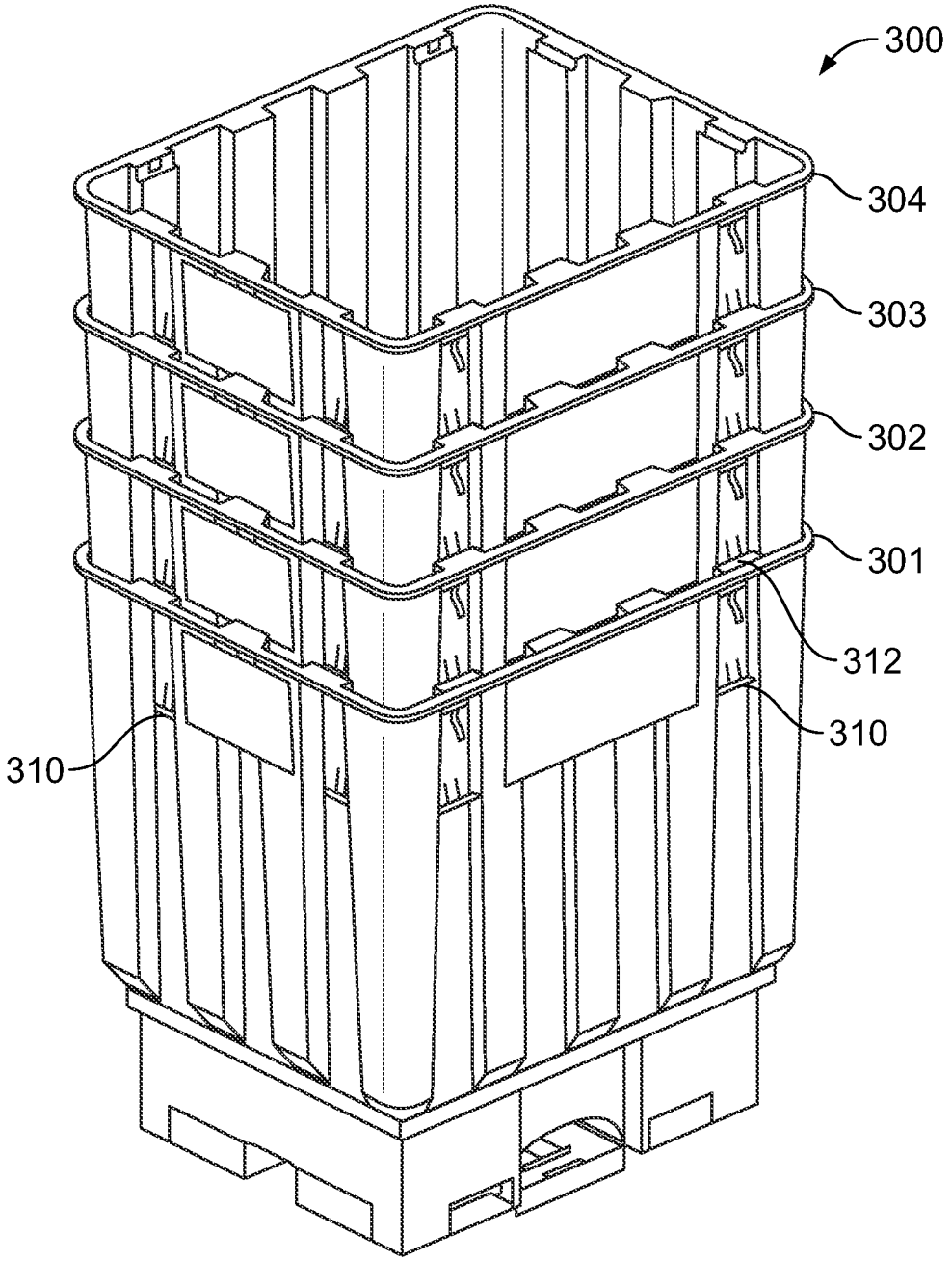
FIG. 3 illustrates four stacked bulk material containers each of which is substantially identical to the bulk material container of FIG. 1.

FIG. 3 illustrates four stacked bulk material containers 301-304 each of which is substantially identical to the bulk material container 100 of FIG. 1. As shown in FIG. 3, the bottom bulk material container 301 includes container walls having an inner surface with an alternating series of projections and recesses. Further, the projections and recesses on the inner surface of the container walls of the bottom container 301 are sized to receive the projections and recesses on the outer surface of the container walls of the next higher container 302. Similarly, the inner surface of the container walls of the container 302 are sized to fit the outer surface of the container walls of container 303 and so forth.

Additionally, each container 301-304 includes on its exterior wall surface a number of vertical stops 310. The vertical stops 310 preferably are placed on each of the four side walls. The vertical stops 310 include a flat ledge on their lower portion so that, as the container is lowered into the interior of another container during stacking, the flat ledge on the bottom of the vertical stop 310 comes into contact the top of one of the projections on the inner surface of the container walls. Once the vertical stop 310 contacts the top of the projection, it stops the downward motion of the container.

Thus, when the bulk container 302 is lowered into the bulk container 301 in a stacking operation, the bulk container 302 will be lowered downward until the vertical stops 312 on the exterior surface of the bulk container 302 come into contact with the top of the projections on the interior surface of the bulk container 301. Once the vertical stops contact the interior projections, the downward motion of the bulk container 302 is stopped and the stacking operation is complete.

The series of projections and recesses and the vertical stops operate to control how the bulk material container 301-304 are disposed relative to each other when stacked. For example, when the stacking operation of container 302 into container 301 is initiated, container 302 is lowered into container 301 until the projections/recesses of the interior surface of the container 301 engage the projections/recesses of the outer surface of the container 302. The projections/recesses of the inner and outer surfaces are preferably sized so that the projections/recesses of the lower container 301 can accommodate those of the upper container with some clearance so that the projections/recesses do not unnecessarily rub against each other or cause friction during the stacking operation. Consequently, the projections/recesses may preferably help guide the positioning of the containers relative to each other without potentially damaging one or both of the bulk containers. Some contact is certainly inevitable, but the downward motion of the container 302 into container 301 is preferably stopped by contact of the vertical stops with the tops of the interior projections, as opposed to friction between the projections/recesses of containers 301 and 302.

Additionally, the vertical stops are positioned so that the bottom of the hopper of the upper container 302 remains suspended and does not contact the interior surface of the lower container 301 including the side walls and the bottom. This positioning is especially desirable when the hopper of the upper container is constructed of metal and the side walls of the lower container are constructed of plastic.

Additionally, because the downward motion of the upper container into the bottom container is stopped by the vertical stops and the projections/recesses of the upper and lower containers are not in substantial frictional contact, the upper container may be easily lifted out of the lower container. For example, in some prior art containers, when an upper container is stacked into a lower container, the downward motion of the upper container is stopped only by friction between the interior surface of the lower container and the exterior surface of the upper container. Unfortunately, in such prior art containers, the additional friction between the containers may make the containers very difficult to remove from one another. For example, in some cases, a vacuum or a lower-pressure region may happen between the surfaces of the containers, which may tightly and undesirably seal the containers together. Conversely, in the present bulk material container, no such vacuum takes place because the vertical stops cause the downward motion of the upper container to stop and there is preferably some clearance between the projections/recesses of the inner and outer surfaces.

Returning to FIG. 2, both the long side walls 204 and short side walls 205 are constructed so that they have wrap-around angle portions 230 at the lateral edges of the walls. The wrap-around angle portions 230 of two adjacent walls are sized to receive one another so that the angle portions 230 of the adjacent walls may be joined together to connect the walls. For example, the angle portions of adjacent walls may be joined together by mechanical interlocking, structural hinging, adhesion, and/or welding. Alternatively, the angle portions of adjacent walls may merely be placed in contact with each other and the walls may be held in the shape of the container by the top tube 209 around the top of the walls and the top lip 240 of the hopper 201.

Additionally, the series of projections and resources on the interior and exterior surfaces of the walls adds structural strength to the walls, both laterally and vertically.

Turning now to the top tube 209, the top tube 209 is received under an upper lip 232 that appears at the upper extent of the long side walls 204 and short side walls 205. The top tube 209 is preferably fixedly installed into the walls 204, 205, for example by providing a structure under the upper lip 232 into which the top tube 209 is received, for example, a molded plastic structure sized to receive and retain the top tube 209. Alternately, the top tube may be adhesively attached to the side walls.

As shown in FIG. 2, the top tube 209 is preferably composed of two U-shaped portions that are joined together by the tube inserts 210 to form a rectangular tube element that is positioned under the upper lip of the walls 204, 205. The tube element is also shown in FIGS. 1 and 3. Further, the tube element is preferably composed of metal and adds additional structural strength to the bulk container in several ways. For example, the tube 209 may provide additional support for the lid frame 207 to provide additional structural strength to assist in stacking full bulk material containers on top of one another. Additionally, when full or loaded containers are stacked, the upper container may exert a downward force on the lower container which may attempt to bias apart the side walls of the lower container. In opposition, the tube 209 wraps firmly around the side walls of the lower container to assist in holding them together.

Returning to FIG. 2, the long side walls 204 also include the lid hatches 211. The lid hatches 211 cooperate with the lid hatch keepers 208 of the lid 110 in order to seal the lid 110 to the container walls 120. Although FIG. 2 shows the lid hatches positioned solely on the long side walls 204, the lid hatches may be positioned on the short side walls instead or in addition to the long side walls. Also, although two hatches are shown per side, a greater or lesser number of hatches may be employed. Additionally, hatching systems may be employed that use a lid having on one side a hinge element that is received by the top of the side wall and then a single latch on the side wall opposite the hinge element.

As shown in FIG. 2, the container walls preferably also include a document pouch 217. The document pouch may be used to store documents relevant to the storage of the container, transportation of the container, or materials inside the container, for example.

Additionally, the container walls preferable also include a branding placard 218. The branding placard may display the name of the owner and/or manufacturer of the container.

Returning now to FIG. 2, the hopper base 130 of FIG. 1 includes the hopper 201, outer feet 202, inner feet 203, hopper chute 212, chute guide 213, chute lock 214, washer 215, and open sticker 216 of FIG. 2. The hopper 201, outer feet 202 and inner feet 203 are preferably constructed of composite and/or plastic and may be glued or adhered together. The hopper is generally shaped like an inverted pyramid having at the lowest extent a rectangular aperture. The hopper chute 213 is positioned to alternatively block the rectangular aperture or allow material to pass through the rectangular aperture.

The outer feet 202 include a plurality of forklift apertures 242. When the outer feet 202 are formed into the hopper base, for example as shown in FIGS. 1 and 3, the forklift apertures 242 provide two apertures on all sides of the container so that the container may be lifted by a forklift from any side.

Additionally, as mentioned above, the hopper 201 includes a top lip 240 that rises vertically around the upper extent of the hopper 201. As mentioned above, the top lip 240 may receive the bottom portion of the side walls of the container inside the top lip 240. In this fashion, the top lip 240 may restrain laterally motion of the bottom of the side walls.

Figure 4:
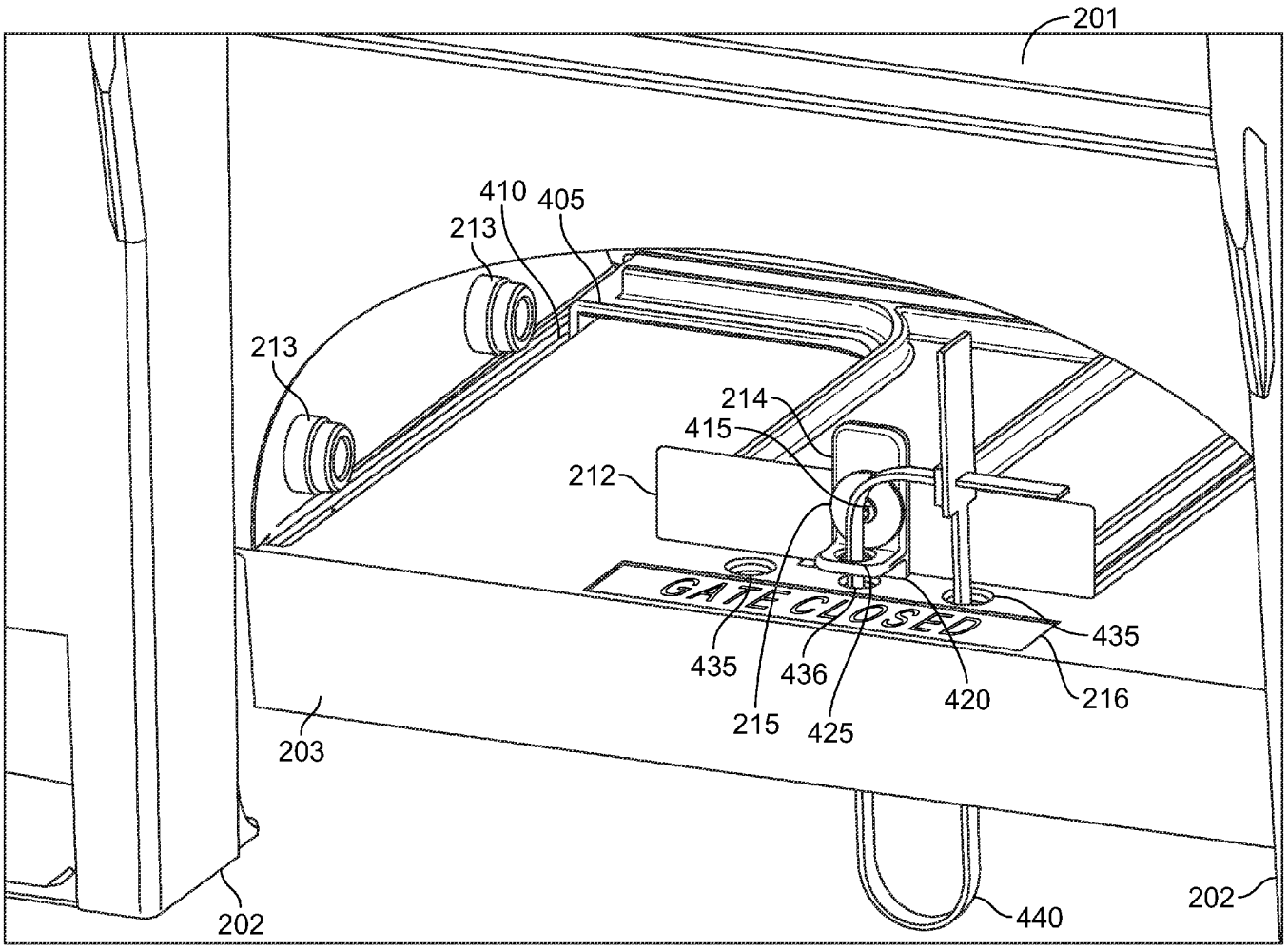
FIG. 4 illustrates the hopper chute in a closed and locked position.
Figure 5:
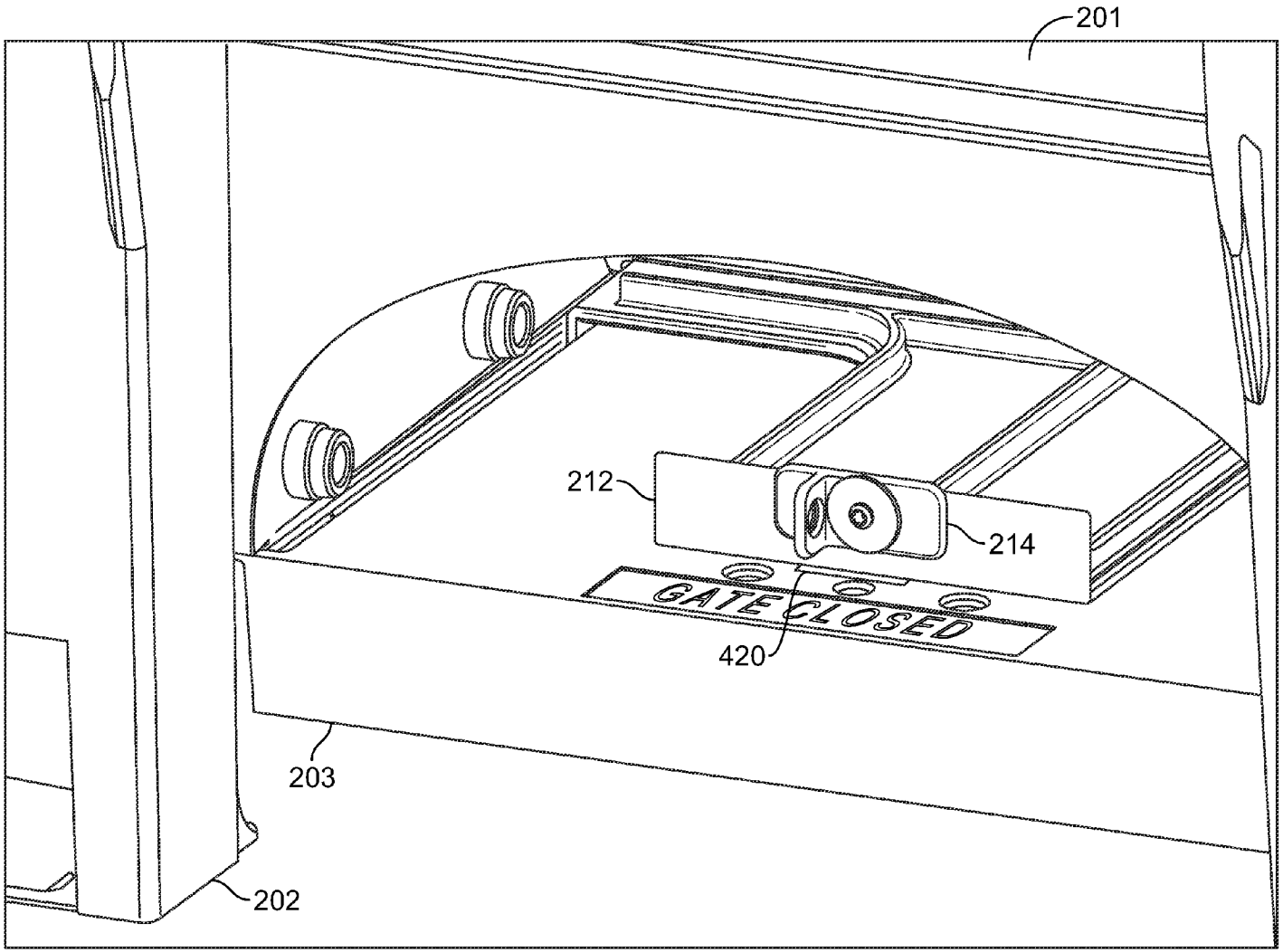
FIG. 5 illustrates the hopper chute in a closed, but unlocked position.
Figure 6:
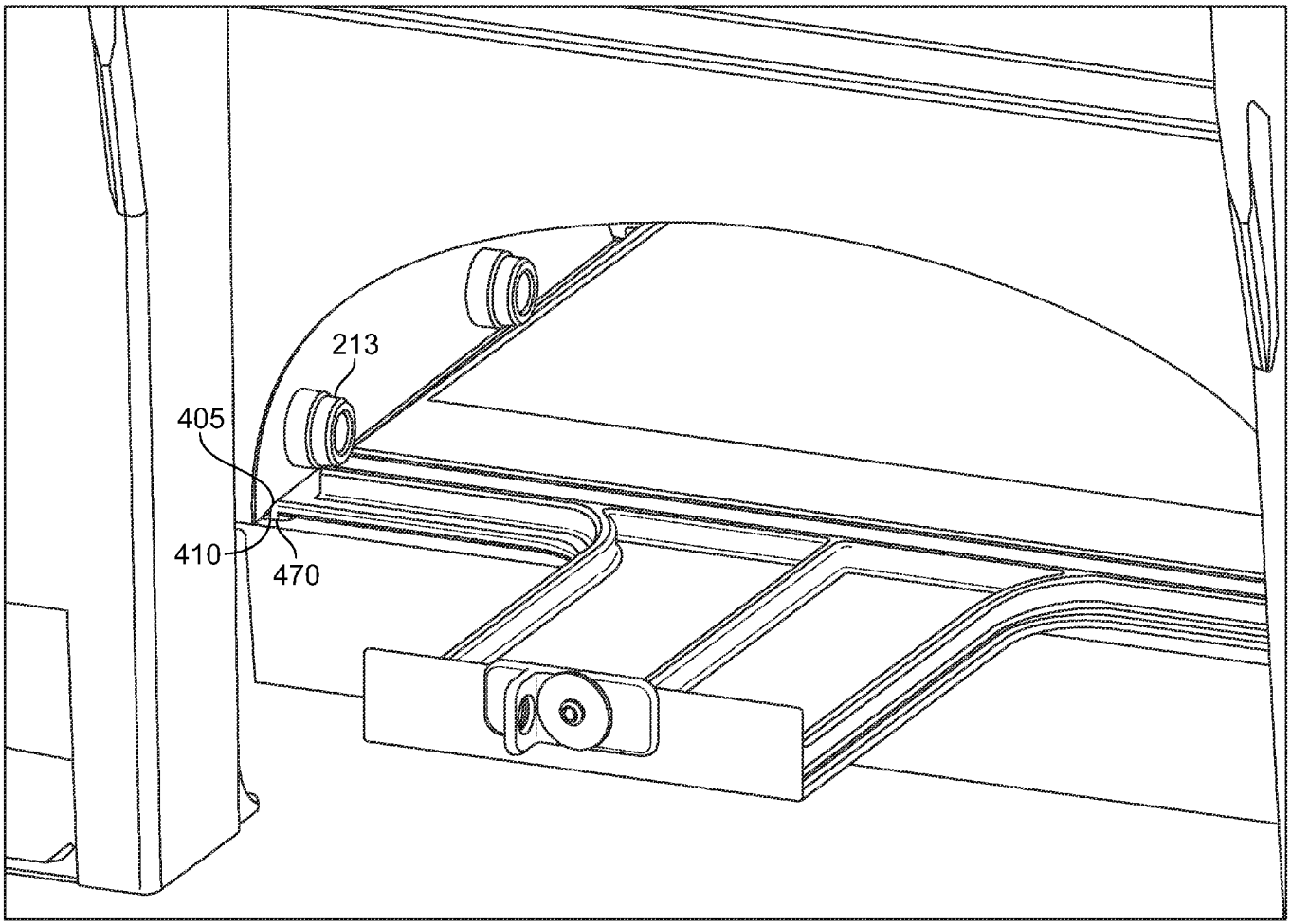
FIG. 6 illustrates the hopper chute in an open position.

FIGS. 4-6 illustrate the operation of the hopper chute 212. FIG. 4 illustrates the hopper chute 212 in a closed and locked position. As shown in FIG. 4, the hopper chute 212 includes an edge 405 that is positioned in a track 410. The operation of the edge and the track 410 serve to restrain the lateral movement of the hopper chute 212. Further, the vertical movement of the hopper chute is restrained by the chute guides 213 positioned above the hopper chute and the upper surface of the inner foot 203 positioned below the hopper chute 212.

Positioned at the front of the hopper chute 212 is the chute lock 214. As shown in FIG. 4, the chute lock 214 is preferably shaped like a sideways "T". The upper branch of the "T" includes a pivot point 415 about which the chute lock 214 rotates. Additionally, the lower branch of the "T" extends into a locking aperture 420 in the inner foot 203. When the chute lock 214 is rotated so that a portion of the chute lock extends into the locking aperture, the chute lock prevents the chute from opening and the chute lock is said to be in the locked position.

Additionally, the base of the "T" also includes a base aperture 425. When the chute lock is rotated to the locked position, the base aperture 425 is aligned with an inner foot base aperture 430. The inner foot 203 also includes a plurality of locking apertures 435. When the chute lock 214 is in the locked position and the base aperture 425 is aligned with the inner foot base aperture 430, a locking tie 440 may be passed through both the base aperture 425 and inner foot apertures 430, as well as one of the locking apertures 435, to lock the chute in position.

FIG. 5 illustrates the hopper chute 212 in a closed, but unlocked position. As shown in FIG. 5, the locking tie 440 has been removed and the chute lock 214 has been rotated out of the locked position to the unlocked position wherein the lower branch of the "T" no longer extends into the locking aperture 420 in the inner foot 203. However, the open sticker 216 is still visible, indicating that the hopper chute remains closed.

FIG. 6 illustrates the hopper chute 212 in an open position. As shown in FIG. 6, the hopper chute 212 has been pulled forward, until the front portion of the edge 405 positioned in the track 410 contacts a stopper 470. The stopper 470 restrains the forward motion of the hopper chute 212 when the hopper chute is opened. Another stopper is positioned at the rear of the track 410 to restrain the reward motion of the hopper chute when the hopper chute is closed. As mentioned above, with the hopper chute 212 in the open position, the rectangular aperture of the hopper 201 is no longer blocked by the hopper chute and materials inside the container are induced by gravity to exit the container through the rectangular aperture.

Figure 7:
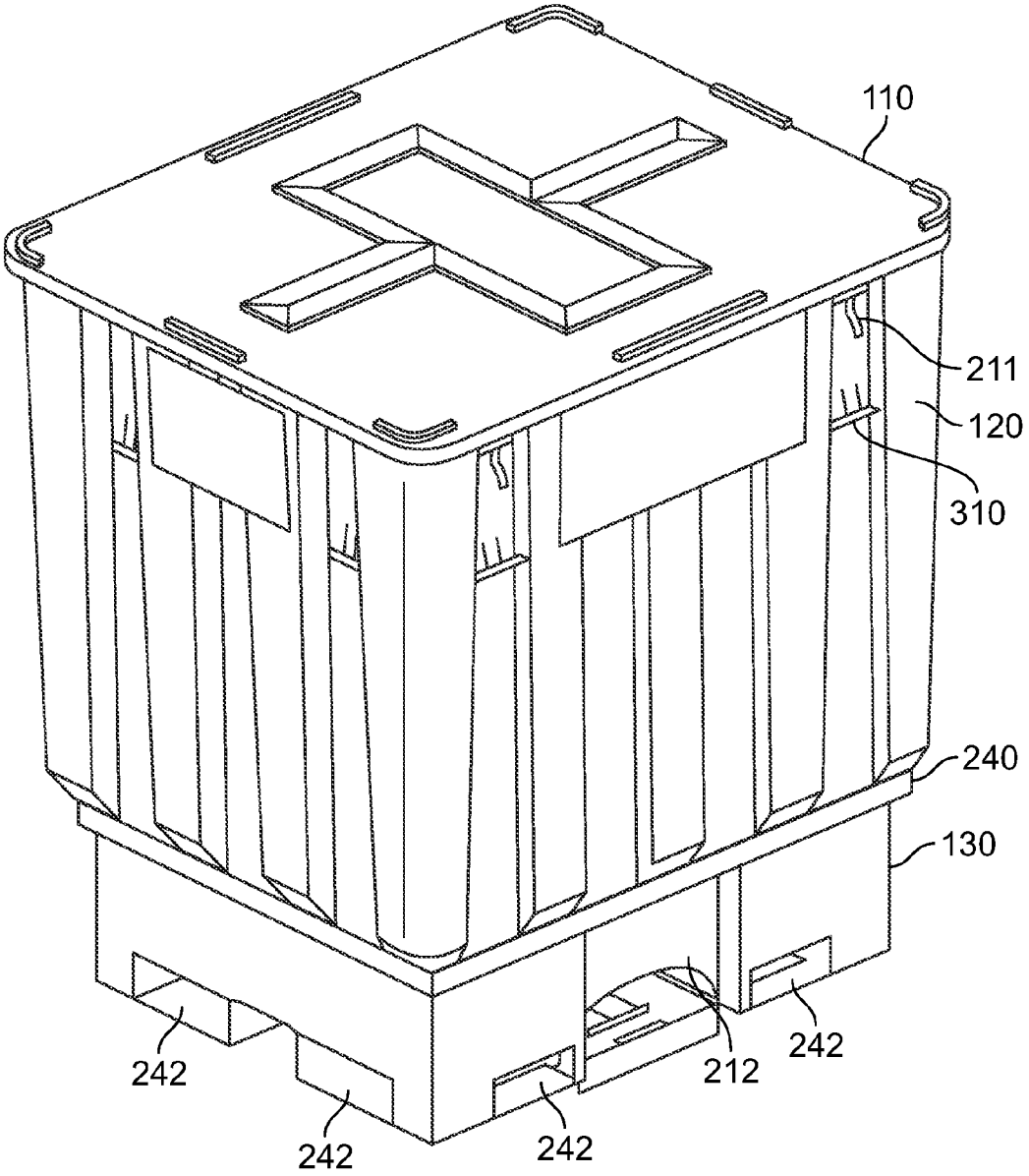
FIG. 7 illustrates a perspective view of the bulk material container of FIG. 1 with the lid, container walls, and hopper base installed.

FIG. 7 illustrates a perspective view of the bulk material container 100 of FIG. 1 with the lid 110, container walls 120, and hopper base 130 installed. FIG. 7 clearly shows the relative positions of the lid hatches 211, vertical stops 310 of the container walls 120 and the top lip 240 of the hopper base 130. Additionally, the relative positions of the forklift apertures 242 are shown. Finally, the hopper chute 212 is in the closed position.

Figure 8:
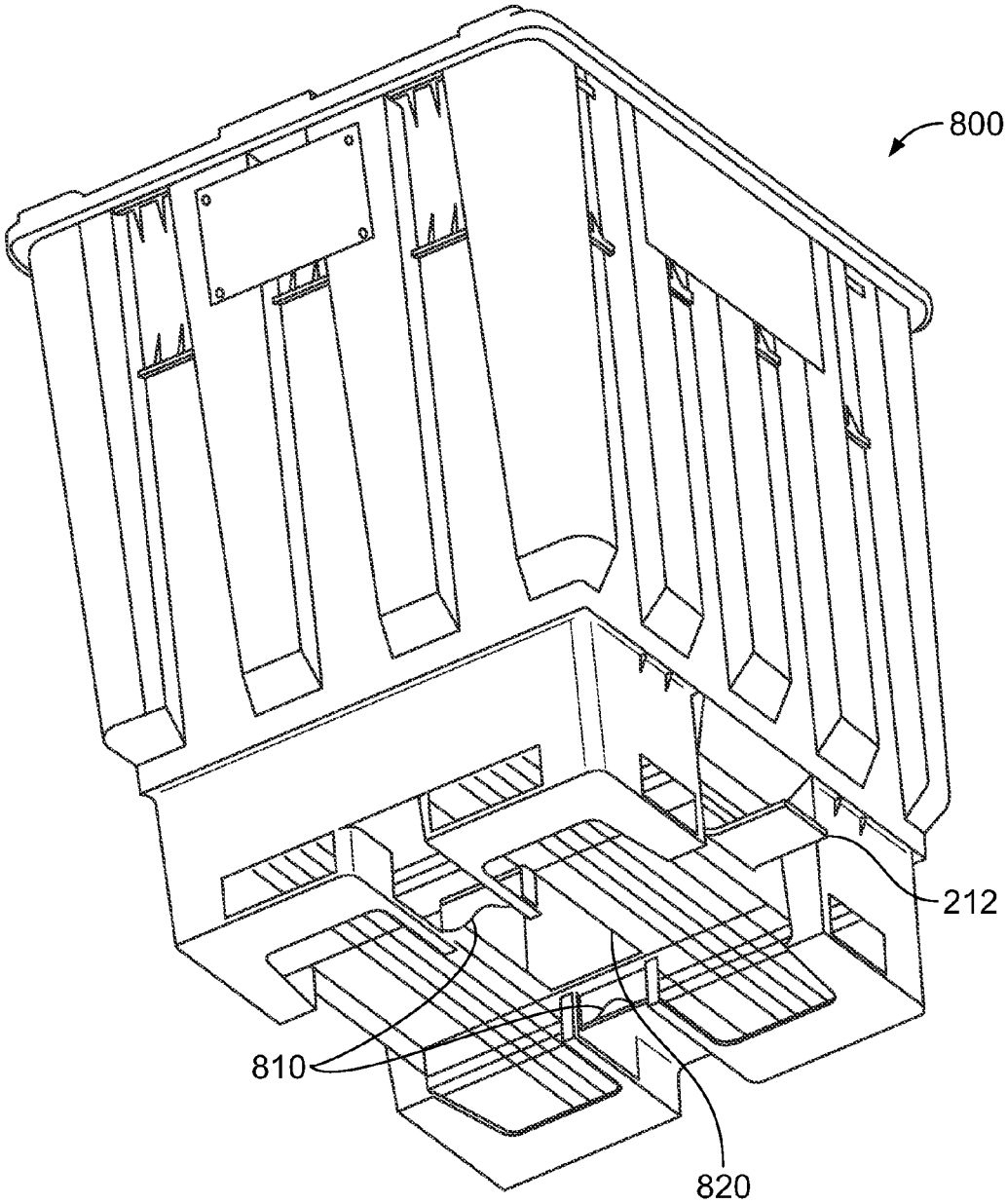
FIG. 8 illustrates a perspective view of the underside of the bulk material container of FIG. 1 with the lid, container walls, and hopper base installed.

FIG. 8 illustrates a perspective view 800 of the underside of the bulk material container 100 of FIG. 1 with the lid 110, container walls 120, and hopper base 130 installed. As shown in FIG. 8, the underside of the hopper base 130 is shaped to interact with the interior lateral motion restraints 222 of a lid 110 upon which the container 100 may be stacked. Especially of note is the angled cut-out 810 that may interact with an angular portion on the lid.

Additionally, the hopper chute 212 is shown in the open position and thus the rectangular aperture 820 of the hopper 201 is open. With the rectangular aperture 820 open, materials that may be inside the bulk material container 100, the materials would proceed to exit the bulk material container 100 through the rectangular aperture 820 under the influence of gravity.

Figure 9:
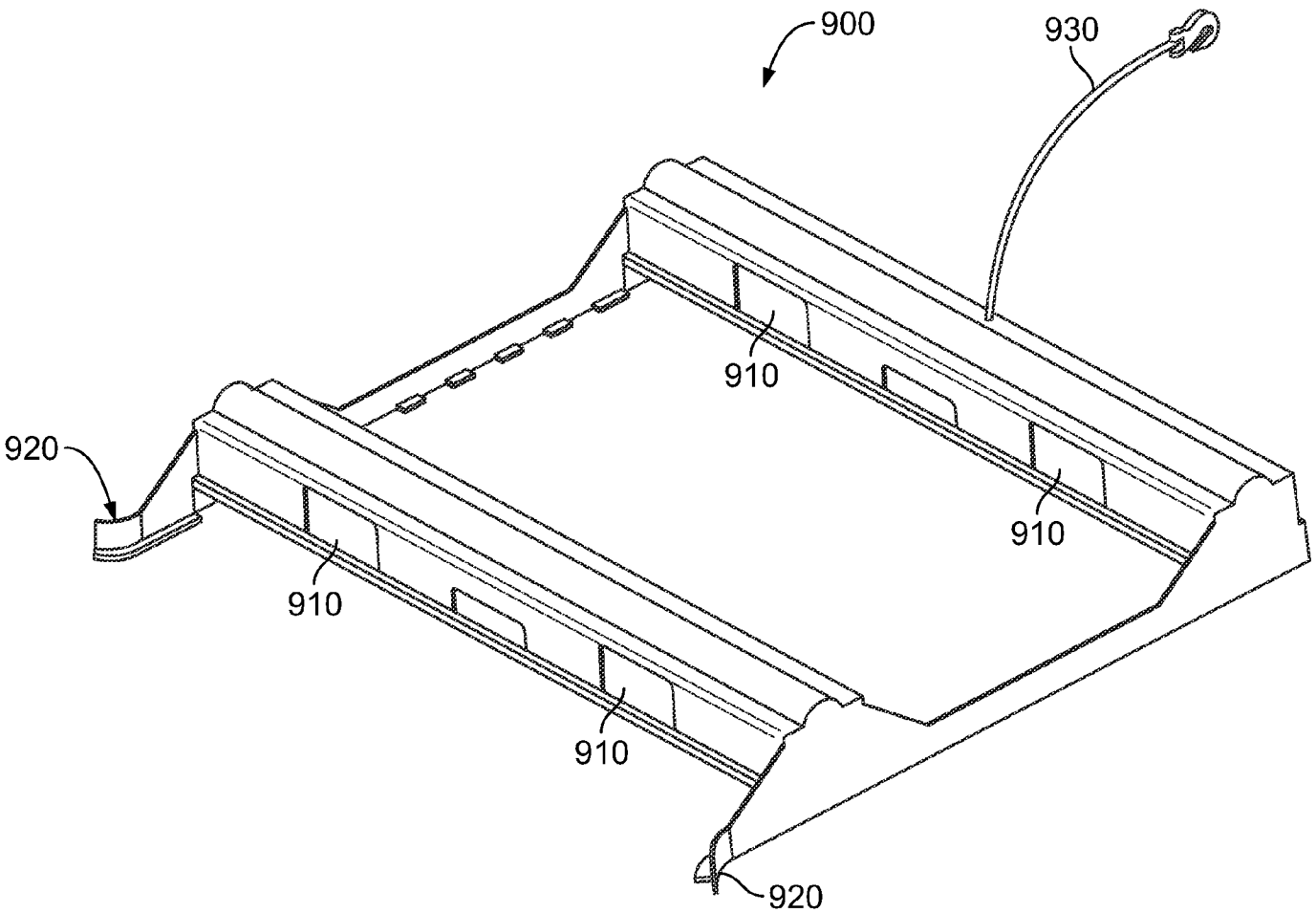
FIG. 9 illustrates a fork attachment for use with the bulk material container of FIG. 1.

FIG. 9 illustrates a fork attachment 900 for use with the bulk material container 100 of FIG. 1. The fork attachment 900 is attached to a bulk material container at the container attachment 920. As shown in FIG. 9, the fork attachment 900 slides under the "lip" of the container 100 where the top tube 209 is. When the fork attachment 900 is lifted with the device attached where the small grooves are, it lifts the container by the "lip" of the container at the top.

The fork attachment 900 includes a plurality of forklift apertures 910 for accommodating the lifting arms of a forklift. The fork attachment also includes a safety attachment line 930 for making a secondary attachment of the fork attachment 900 with the forklift.

The fork attachment 900 allows the bulk material container 900 to be lifted near the top of the container rather than at the bottom using the forklift apertures in the outer feet 202. This may provide more desired stability when lifting the container 900 and may allow the container to be lifted more easily when it is placed on certain surfaces, such as mud for example.

Additionally, fork attachment 900 may be a composite lift attachment that slides under the top lip of the container. In an embodiment, the lift attachment may be designed to lift an empty container and designed to flex and slip off in the event that a user attempts to lift a container with product and/or material in it. For example, the attachment may be specifically designed for the weight of an empty container only.

Figure 10:
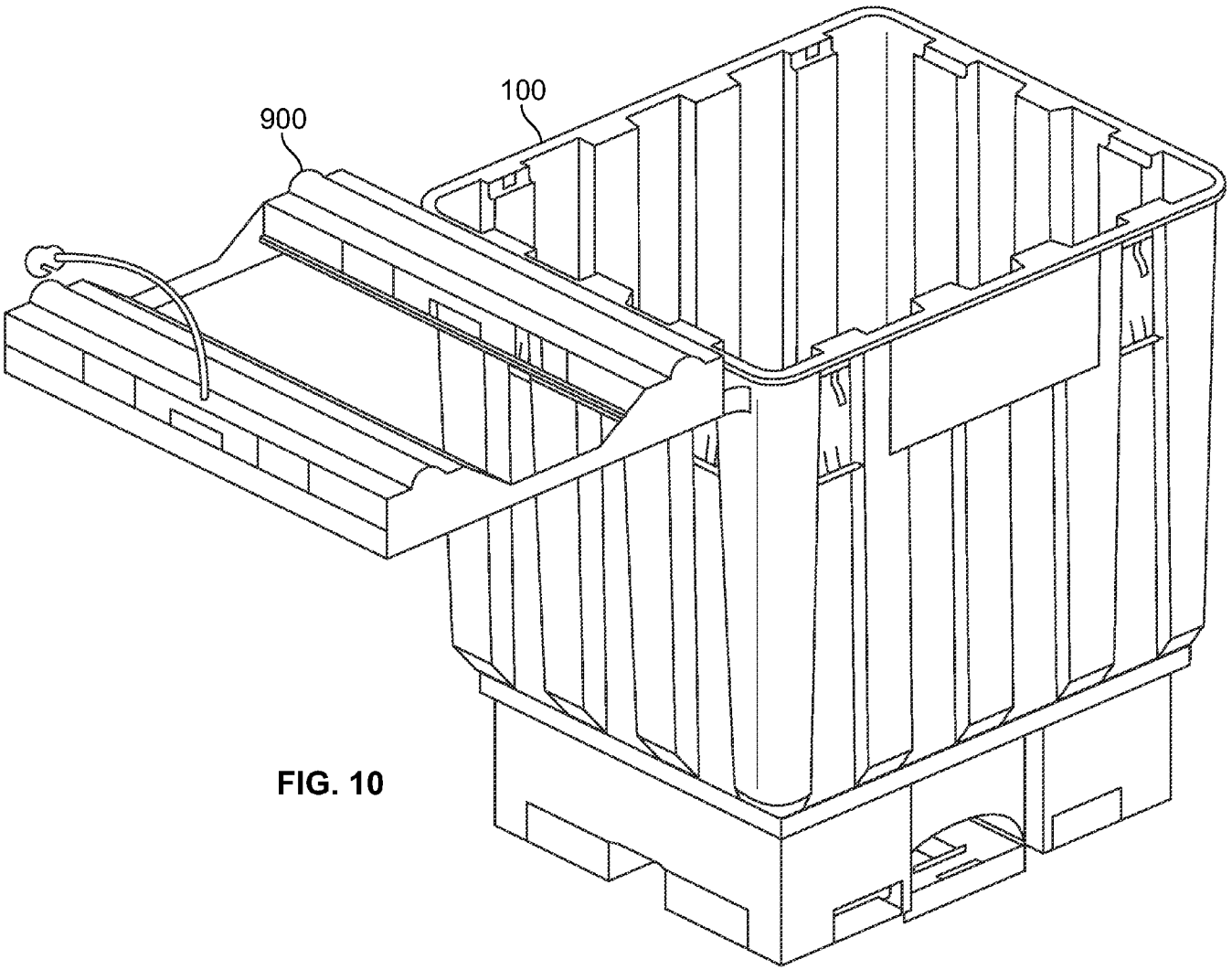
FIG. 10 illustrates the fork attachment aligned on a bulk material container.

FIG. 10 illustrates the fork attachment 900 aligned to be installed on a bulk material container 100.

Figure 11:
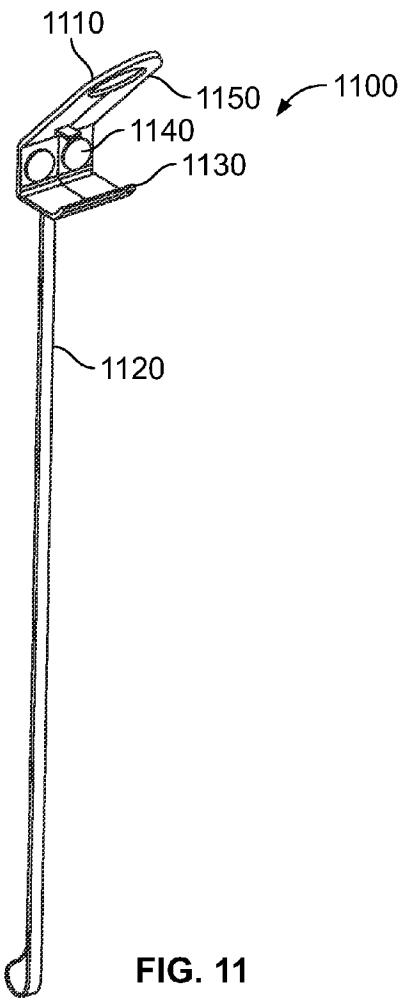
FIG. 11 illustrates a hook assembly for use in moving a bulk material container.

FIG. 11 illustrates a hook assembly 1100 for use in moving a bulk material container. The hook assembly 1100 includes a hook head 1110 and a nylon tether 1120. The hook head 1110 includes a hook arm 1130, a plurality of magnets 1140, and a strap hole 1150.

Figure 12:
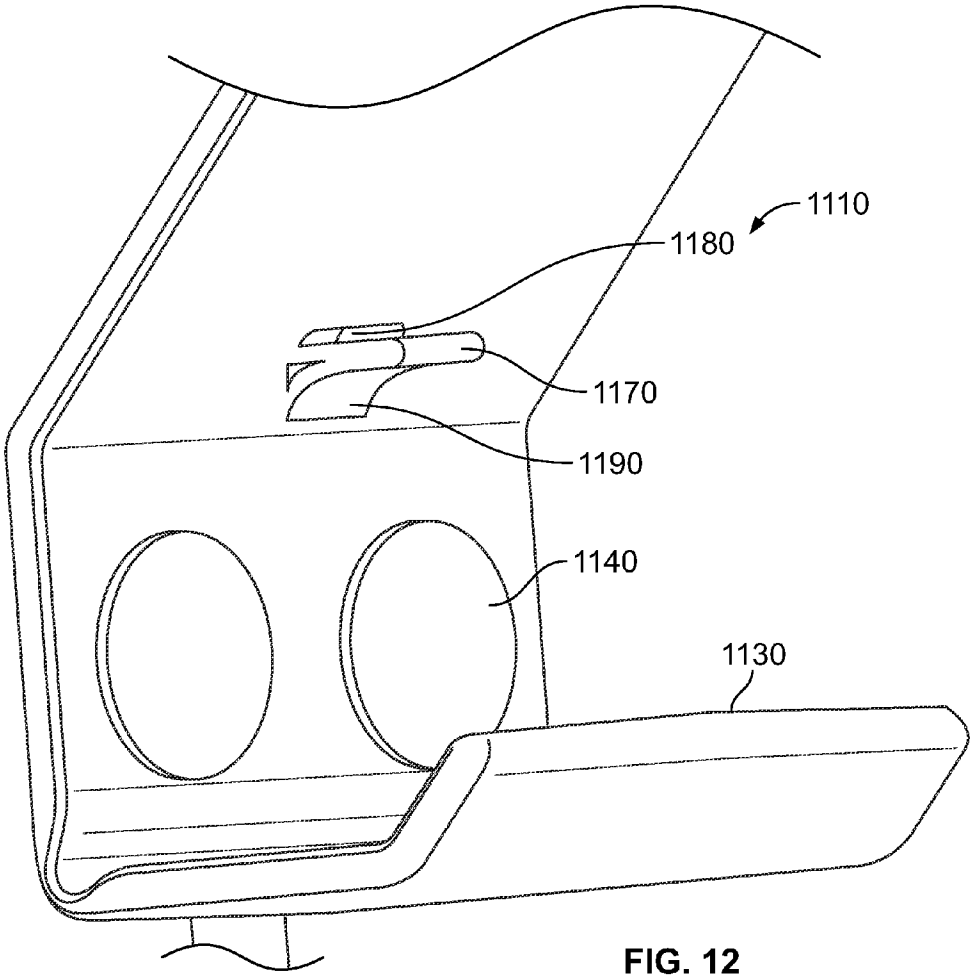
FIG. 12 illustrates a close-up view of the hook head of the hook assembly of FIG. 11.

FIG. 12 illustrates a close-up view of the hook head 1110 of the hook assembly 1100 of FIG. 11. FIG. 12 shows the hook arm 1130, the magnets 1140, and a restraining pin 1170.

Figure 13:
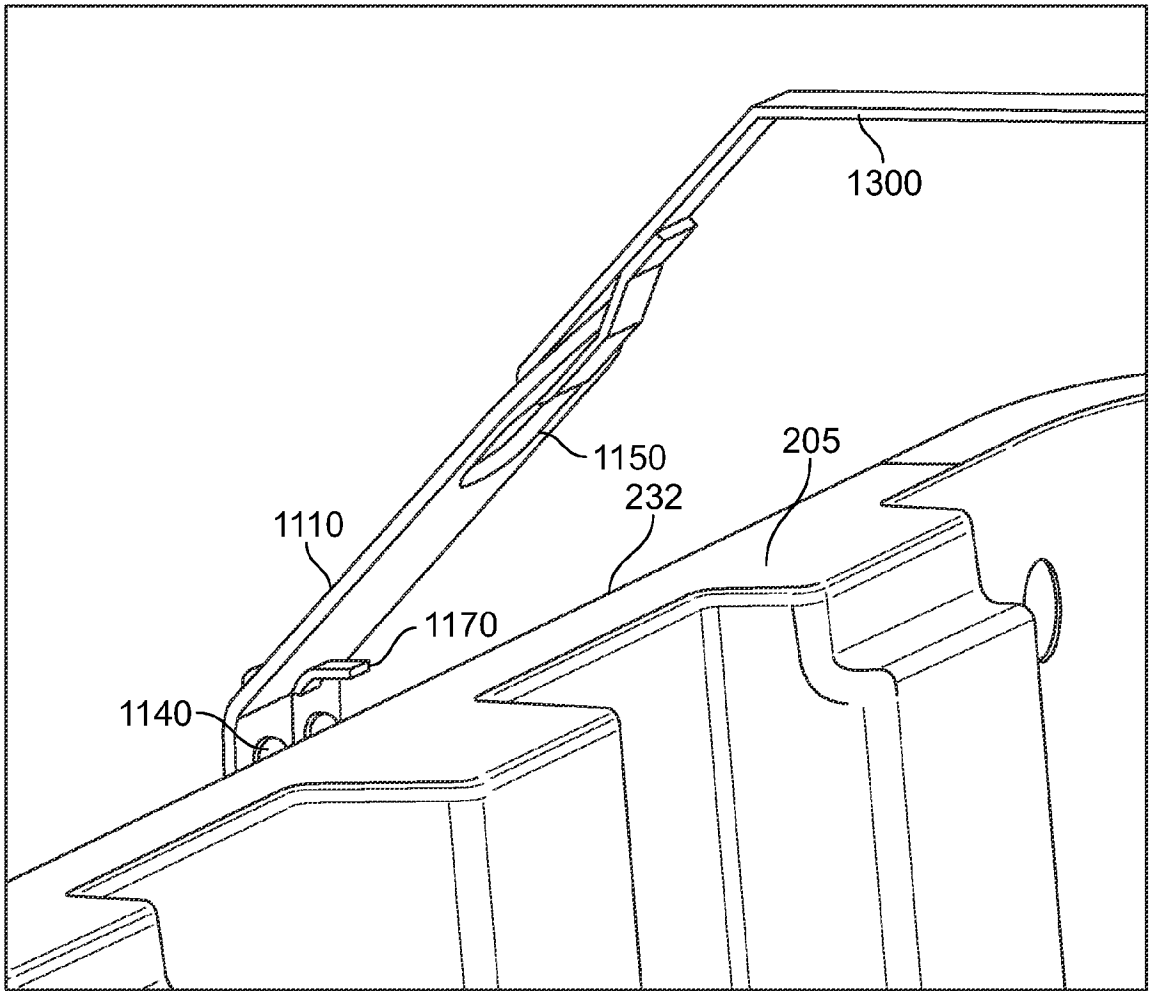
FIG. 13 illustrates the hook assembly of FIGS. 11 and 12 installed on a bulk material container.

FIG. 13 illustrates the hook assembly 1100 of FIGS. 11 and 12 installed on a bulk material container. As shown in FIG. 13, the hook arm 1130 of the hook assembly 1100 hooks underneath the top tube 209 that is positioned around the top of the side walls 204, 205 and underneath the upper lip 232 that appears at the upper extent of the side walls. Additionally, because the top tube 209 is preferably made of metal, the magnets 1140 magnetically attach the hook head 1110 to the top tube 209. Additionally, as shown in FIG. 13, a strap 1300 has been introduced into the strap hole 1150.

The restraining pin 1170 is used to attach the nylon strap to the hook head 1110. More specifically, the hook head 1110 includes a strap aperture 1180 and an attachment end of the nylon strap is introduced through the strap aperture 1180. Once the attachment end of the nylon strap is introduced through the strap aperture, a diverging portion 1190 of the attachment end is biased downwardly away from the nylon strap. If an attempt is made to withdraw the nylon strap from the strap aperture, the diverging portion 1190 comes into contact with the strap aperture to prevent the nylon strap from being withdrawn. However, if a user desires to remove the nylon strap, the diverging portion 1190 may alternately be biased upward by a user so that the diverging portion 1190 no longer contacts the strap aperture as the strap is being withdrawn.

Figure 14:
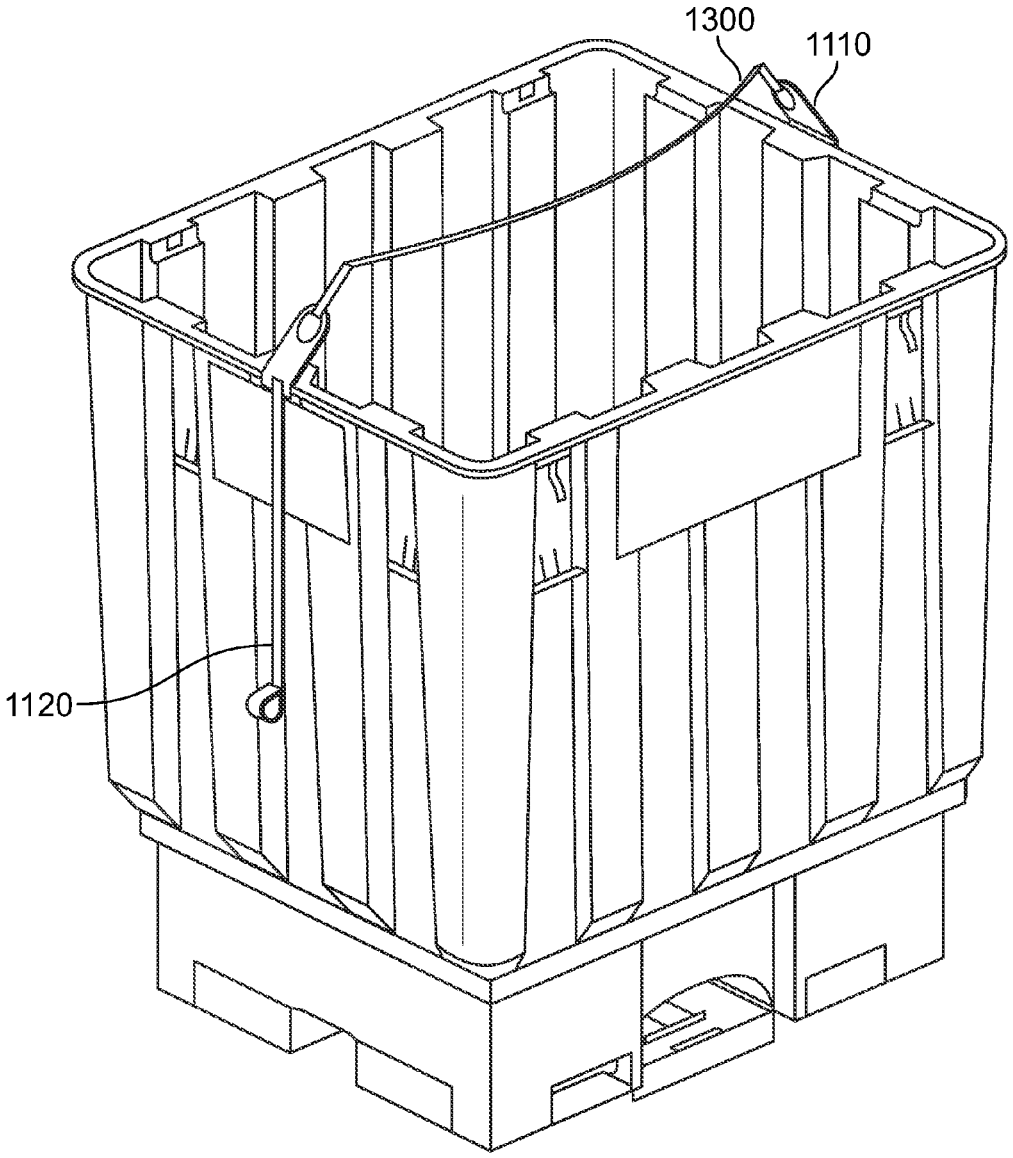
FIG. 14 illustrates a perspective view of the bulk material container with the hook assembly installed.

FIG. 14 illustrates a perspective view of the bulk material container with the hook assembly 1100 installed. As shown in FIG. 14, the hook head 1110 of the hook assembly 1100 hooks underneath the top tube 209 and is magnetically help to the tub tube. A strap 1300 connects a hook head on one side of the container with a hook head on the opposite side of the container.

The strap 1300 forms a handle by which the container may be moved. For example, a forklift arm may be inserted under the strap 1300 and the forklift raised in order to raise the container from the ground for transport.

Figure 15:
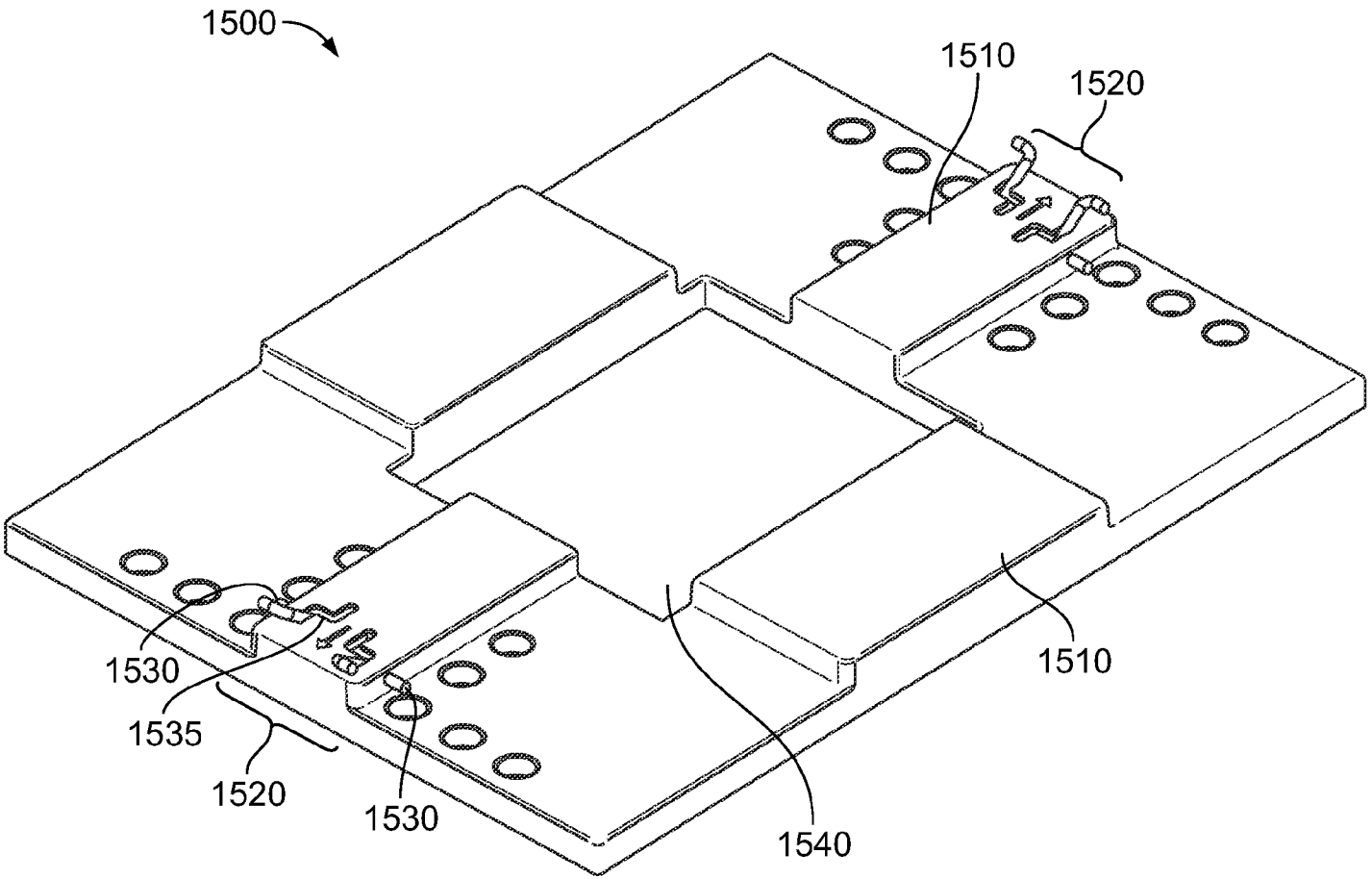
FIG. 15 illustrates a tender adapter to connect a bulk material container to a seed tender.

FIG. 15 illustrates a tender adapter 1500 to connect a bulk material container to a seed tender. The tender adapter 1500 includes several lateral motion restraints 1510 that engage with similarly shaped structures on the base of a container placed on top of the seed tender in order to reduce the lateral motion of the container relative to the tender adapter 1500, much like the lateral motion restraints 222 on top of the lid 110 discussed above.

The tender adapter 1500 also includes a plurality of container locks 1520 for locking a container to the tender adapter. The container locks 1520 include a plurality of locking pins 1530 that extend through a the side surface of a hopper base 130 of a container placed on the tender adapter 1500 to lock the container to the tender adapter 1500. As shown in FIG. 15, the locking pins are movable in the locking pin track 1535 so that the container may be engaged and disengaged from the tender adapter 1500.

Figure 16:
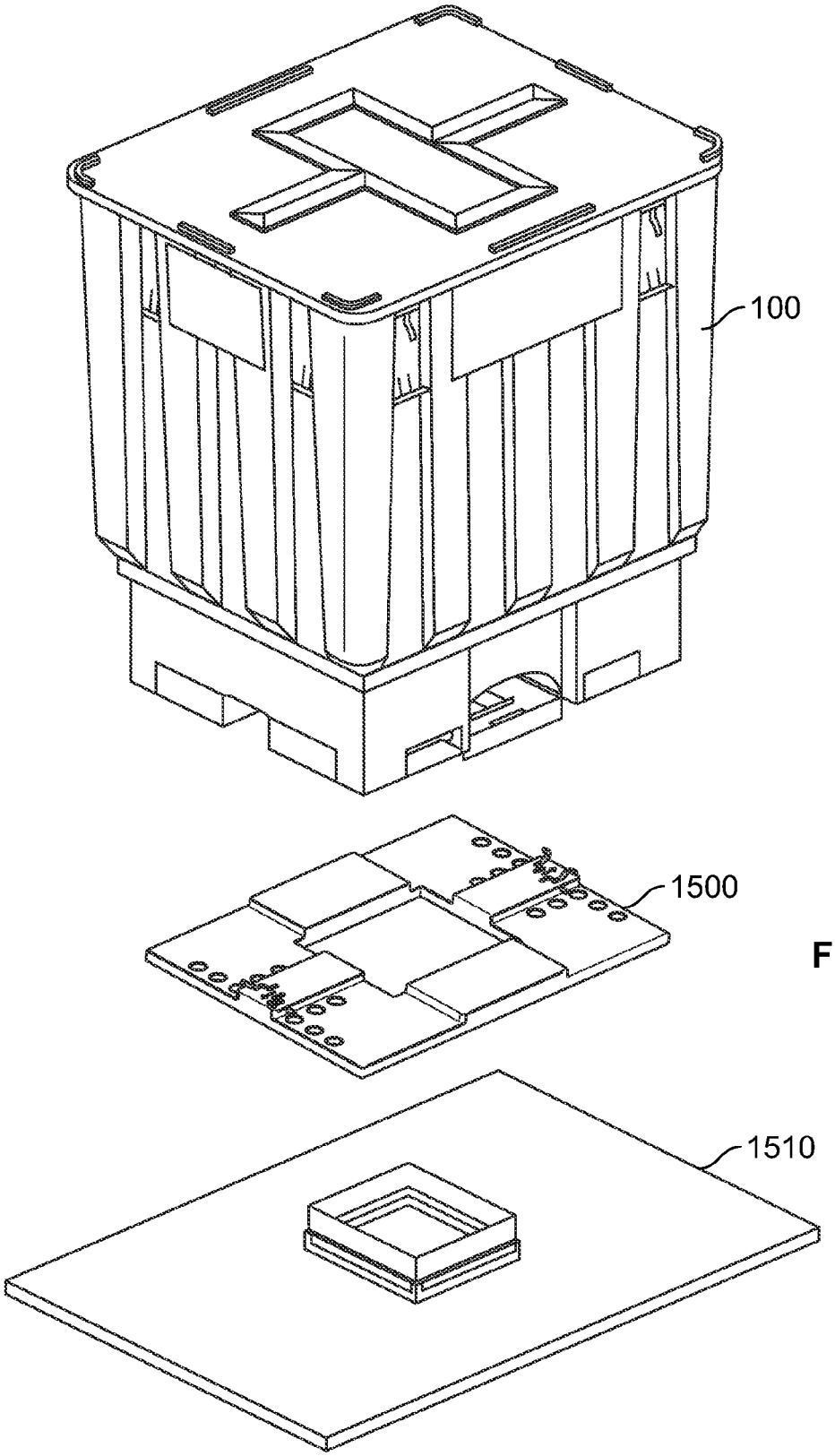
FIG. 16 illustrates an exploded view of the container, the top surface of a seed tender, and the tender adapter.

FIG. 16 illustrates an exploded view of the container 100, the top surface of a seed tender 1610, and the tender adapter 1500. As mentioned above, the container is removable attachable to the tender adapter 1500. The tender adapter 1500 is preferably fixed to the seed tender 1610, for example by welding or adhesion.

Figure 17:
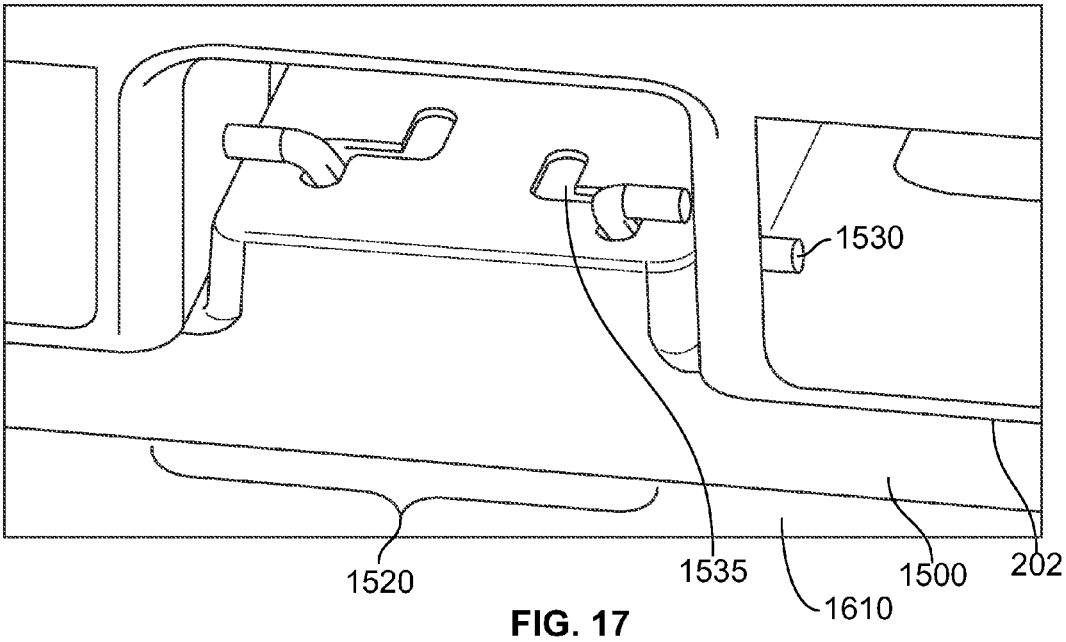
FIG. 17 illustrates a close up of a container installed into a tender adapter.

FIG. 17 illustrates a close up of a container installed into a tender adapter 1510. As shown in FIG. 17, the container includes a hopper 110 with an outer foot 202. The outer foot 202 includes a plurality of holes allowing the locking pins 1530 to be inserted into the holes so that the container may be locked to the tender adapter 1510. As shown in FIG. 17, the locking pins 1530 are in the licked position within the pin track 1535. Conversely, when the locking pins 1530 are conducted to the opposite end of the pin track 1535, the locking pins 1530 withdraw from engagement with the apertures in the outer foot 202 and the container is thus no longer connected to the tender adapter 1510.

Figure 18:
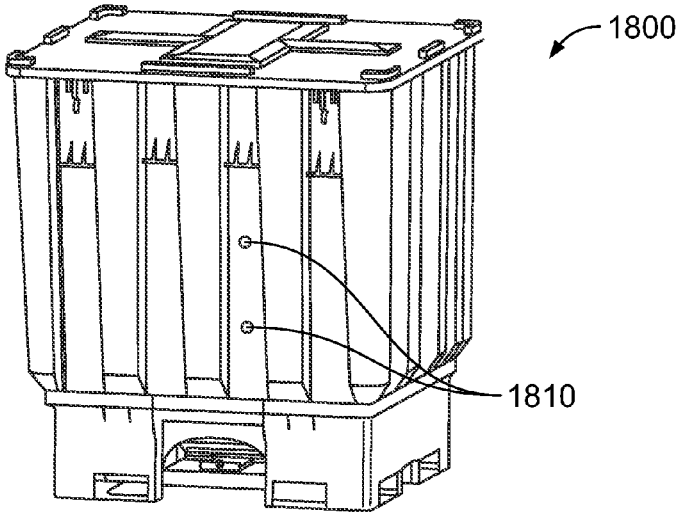
FIG. 18 illustrates an alternative embodiment of the bulk material container of FIG. 1.

FIG. 18 illustrates an alternative embodiment 1800 of the bulk material container 100 of FIG. 1. The container of FIG. 18 include a plurality of sight glasses 1810. The sight glasses are preferably transparent or translucent structures that are placed in one or more of the side walls of the container so that a user may determine how full the container is by observing the sight glasses 1810. For example, if the lower sight glass is dark but the upper sight glass is light, a user may determine that the amount of material in the container is higher than the lower sight glass, but lower than the upper sight glass.

Although the sight glasses 1810 shown in FIG. 18 are two round areas, the sight glass may be configured in many different ways. For example, a continuous transparent or translucent strip from near the base of the container to near the top may be employed. Alternatively, additional sight glasses may be employed. Further, the sight glasses may appear on one or more of the walls of the container. Also, the sight glasses may be composed of any transparent or translucent materials, such as glass or plastic.

Figure 19:
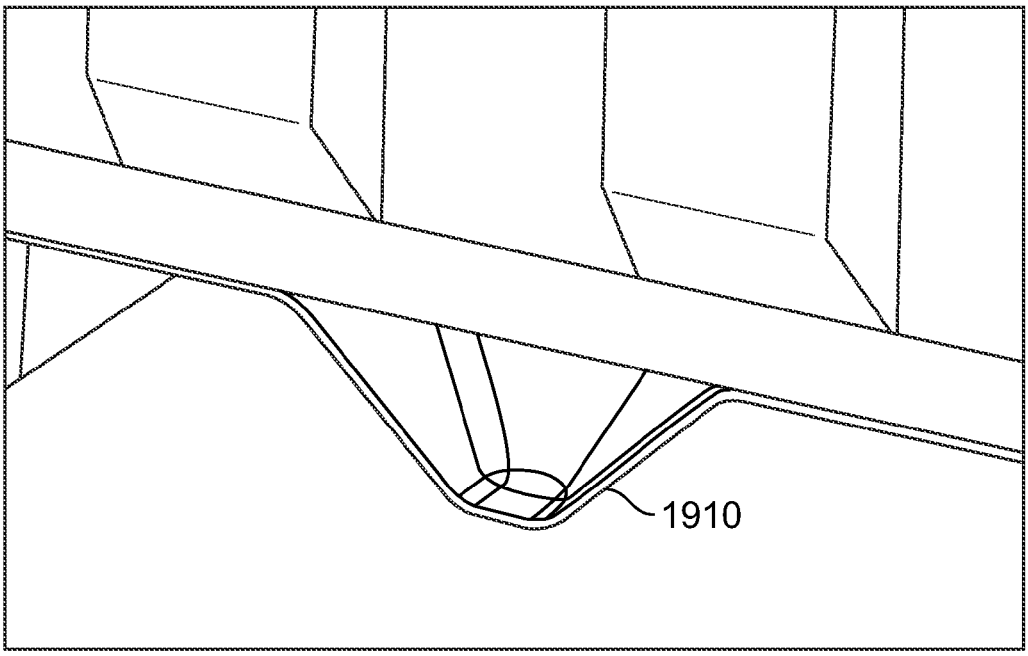
FIG. 19 illustrates an alternative embodiment of the bulk material container of FIG. 1 having a liquid spigot port.

FIG. 19 illustrates an alternative embodiment of the bulk material container 100 of FIG. 1 having a liquid spigot port 1910. The liquid spigot port 1910 may be installed in the hopper base in addition to or instead of the hopper chute 212. The liquid spigot port 1910 may be employed when draining liquid from the container and may be employed in conjunction with the tank insert described below.

Figure 20:
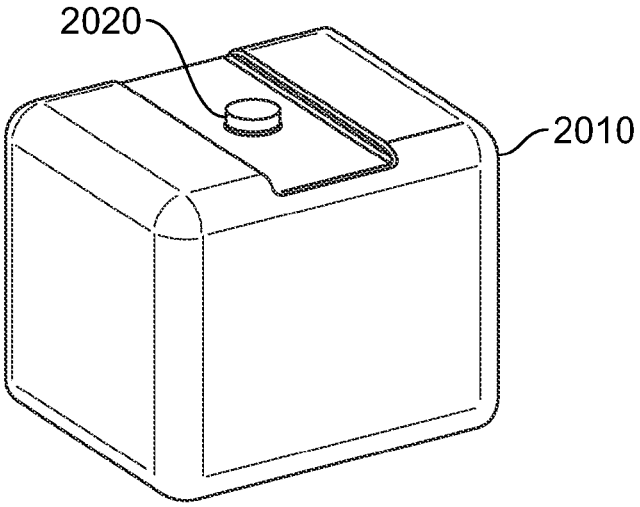
FIG. 20 illustrates a liquid tank that may be inserted into the bulk material container.

FIG. 20 illustrates a liquid tank 2010 that may be inserted into the bulk material container. The liquid tank 2010 is preferably sized to filled the interior of the bulk material container and includes a re-sealable tank cap 2020 to allow the liquid tank 2010 to be filled and refilled with liquid.

Figure 21:
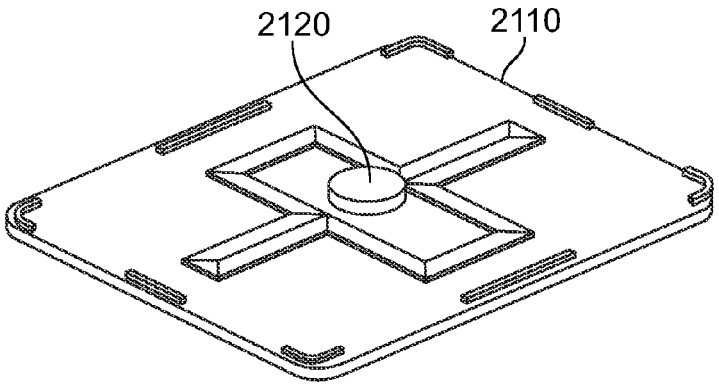
FIG. 21 illustrates an alternative lid for use with the liquid tank.

FIG. 21 illustrates an alternative lid 2110 for use with the liquid tank 2010. As shown in FIG. 21, the alternative lid 2110 is similar to the lid 110 of FIG. 1, but includes in addition the lid cap 2120. The lid cap 2120 is a re-sealable cap that allows liquid or other materials to be introduced into the container without removing the lid. The lid cap 2120 is preferably larger in diameter than the tank cap 2020 so that a user may first remove the lid cap and then reach through the aperture of the lid cap to remove the tank cap 2020 through the aperture of the lid cap. In this way, a user may add liquid directly to a liquid tank without removing the lid 2110.

Figure 22:
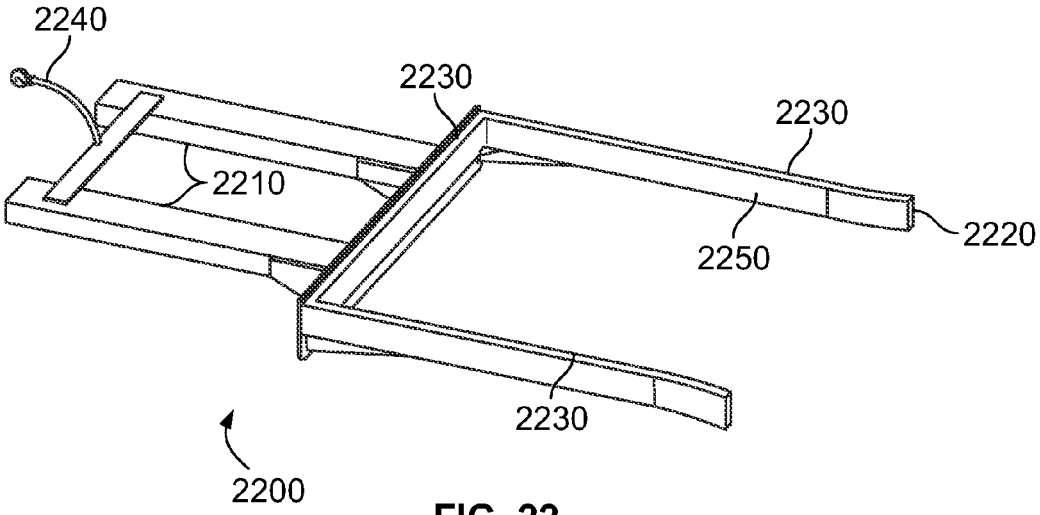
FIG. 22 illustrates a heavy duty lift attachment for transporting one or more bulk material containers.

FIG. 22 illustrates a heavy duty lift attachment 2200 for transporting one or more bulk material containers. The lift attachment 2200 includes a plurality of forklift arm receiving sleeves 2210 for receiving the arms of a forklift. The lift attachment 2200 includes a plurality of lifting arms 2220 that extend around the outside of a bulk material container. The lifting arms 2220 may be sized to fit around either the short or long side walls of the container. The lifting arms 220 include a top surface 2230 a safety attachment line 2240.

In operation, the arms of a forklift are introduced into the forklift arm receiving sleeves 2210 and then the forklift is positioned so that the lifting arms 2220 are on opposite sides of the container at about half the height of the container's side walls. The lifting arms 2220 are then moved upward until the top surface 2230 of the lifting arms 2220 comes into contact with the bottom of the top tube 209 positioned around the top of the side walls as shown above. Further, the container preferably slopes slightly outward with increasing vertical height and the lifting arms are preferably positioned so that the interior surface 2250 of the lifting arms 220 comes to rest against the exterior of the side walls of the container when the upper surface of the lifting arms comes into contact with the lower surface of the top tube 209. In this fashion, the container is held upward by the top surface of the lifting arms underneath the top tube 209 and is prevented from moving laterally by the contact of the interior surface 2250 of the lifting arms with the exterior of the container.

Further, the heavy duty lift attachment 2200 is preferably constructed of metal to allow several stacked containers to be moved at once. For example, in the stacked containers shown in FIG. 3, the heavy duty lift attachment 2200 may be positioned under the top tube 209 of the bottom container 301, but is strong enough to lift the entire stack of containers 301-304. Nor is the total height of the stack limited to four containers and many additional stacked containers may also be lifted at the same time. Additionally, the attachment 2200 may be used when a full container is stacked on top of another full container.

Figure 23:
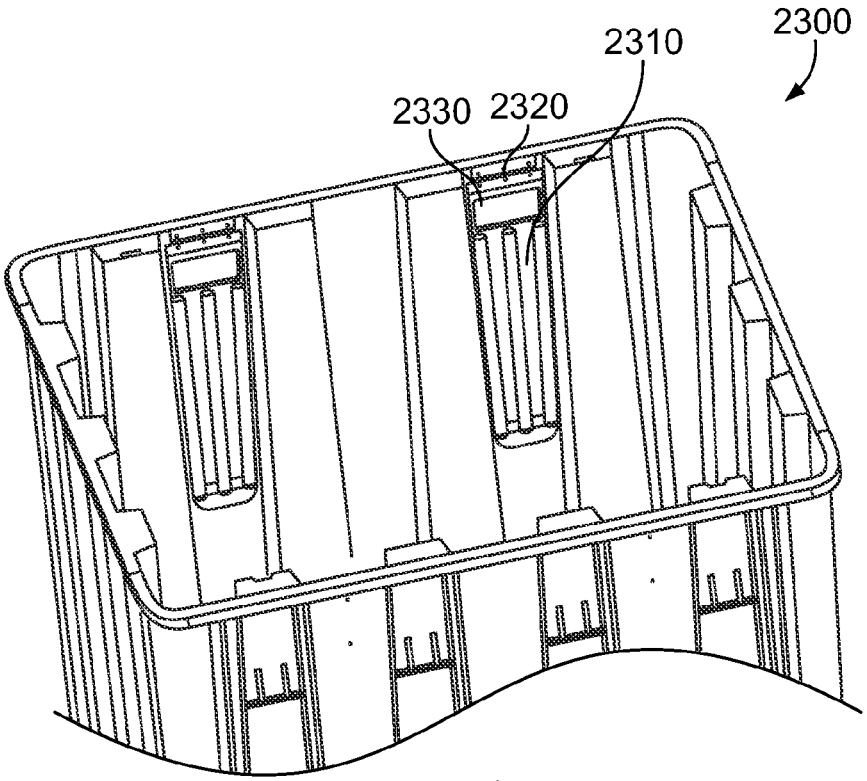
FIG. 23 illustrates an alternative bulk material container with a plurality of lifting flaps.

FIG. 23 illustrates an alternative bulk material container with a plurality of lifting flaps 2310. The lifting flaps 2310 are flaps that hand downward in the interior of the bulk material container as shown in FIG. 23. The lifting flaps 2310 are preferably located in a recess in the interior wall and have a hinge 2320 at the top. The pushing surface 2330 is opposite an aperture in the side of the container wall so that a user may push through the aperture to contact the pushing surface 2330 of the lifting flap 2310, which in turn causes the lifting flap to rotate about the hinge 2320 and open upwardly into the interior of the container.

Figure 24:
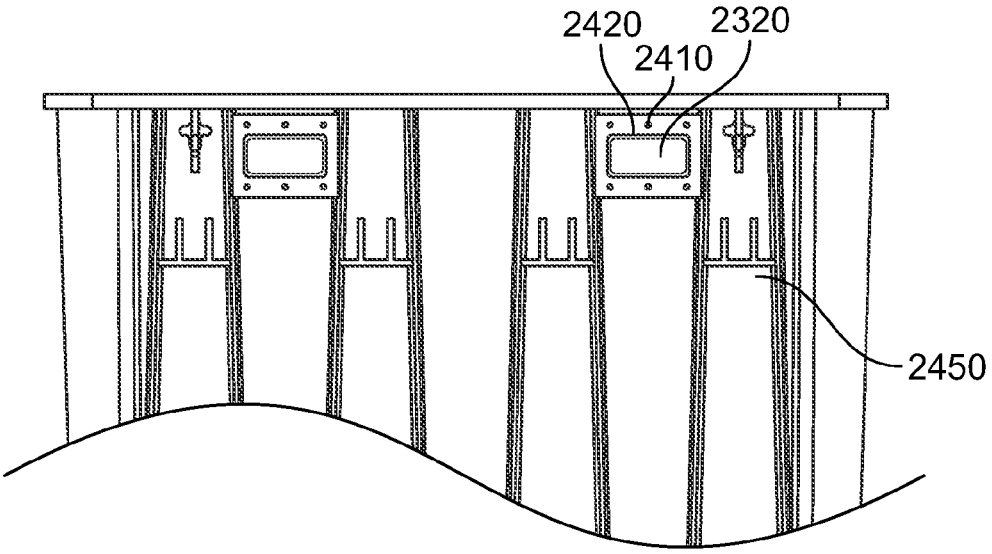
FIG. 24 illustrates an exterior view of the alternative bulk material container of FIG. 23.

FIG. 24 illustrates an exterior view of the alternative bulk material container of FIG. 23. FIG. 24 shows the lifting flap aperture 2420 in the side wall of the container with the pushing surface 2330 of the lifting flap visible through the lifting flap aperture 2420. Additionally, the perimeter of the lifting flap aperture 2410 is preferably reinforced, preferably with metal, so that it is not damaged if a user uses large machinery, such as a forklift to push against the pushing surface 2330.

In operation, a user may introduce the lifting arms of a forklift into the lifting flap apertures 2420 and into contact with the pushing surface 2330 causing the lifting flap 2310 to rotate upward to allow a significant amount of the lifting arms of the forklift to be inserted into the interior of the container. The container may then be lifted by the forklift.

Finally, as shown in FIG. 24, the lifting flap apertures 2420 are positioned above the vertical stops 2450. This allows the container to be stacked, but to still have the lifting flap apertures be accessible when the container is stacked, for example for use in unstacking the container.

In an alternative embodiment to that shown in FIGS. 23 and 24, the container may include an additional set of lifting flaps on the container wall opposite the lifting flaps 2310 shown in FIG. 23. Such a configuration may allow the arms of the forklift to be inserted into the container from either side.

One or more embodiments of the present invention provide one or more of the benefits described below.

With regard to the lifting mechanism with flaps, the system may allow a single person with a fork truck or fork lift to stack and/or unstuck containers.

The lid has an integral structure including the lid frame 207 that strengthens the lid and allows for more sturdy platform and stacking.

The outer feet 202 and inner feet 203 are replaceable. They may be detached from the rest of the container and new feet may be installed. This may be useful if the feet are damaged.

The nesting stops (vertical stops 310, which may look like an upside-down T on the exterior of the side wall) allow the containers to be stacked without a vacuum developing between the walls of the container. However, the stops are positioned so that the lifting flap apertures are not blocked even when the containers are stacked. Further, the stops prevent contact between the metal hopper base of the inside container and the interior surfaces of the exterior stacked container.

The hopper base provides a 4-way pallet base for a fork truck or fork lift so that the container may be lifted from any of the 4 sides.

The container includes several structural advancements that allow the container to be sturdy and rigid without having an undesirable structural support through the center of the container that would prevent stacking. These structural advancements include: the alternating series of projections and recesses on the side walls, the top lip 240 of the hopper restraining the bottom of the side walls, the wrap-around angle portions 230, the top tube 209, and the lid frame 207. Because these structural advancements allow the container to not have to use structural support through the center of the container, a liner may be employed in the container or a liquid tank may be employed as shown in FIG. 20 above. Further, the containers may be nested or stacked.

The top tube 209 serves as a stiffening ring or hoop that provides several advantages. First, it provides another place that the container can be lifted from (underneath the top tube 209). Second, it allows the use of the for truck or fork lift adapter/extension to lift multiple containers as shown in FIG. 22. Third, it increases the rigidity and structural integrity of the container. Fourth, it allows multiple containers to be un-stacked or un-nested at the same time by using the lift attachment 220 to lift multiple containers out of a stacked container at the same time. Conversely, with the lifting flaps shown in FIGS. 23 and 24, typically only a single container may be un-stacked at one time.

Further, multiple lifting designs are provided. For example, a lightweight composite design for individual unit nesting and transportation, a heavy duty steel unit for multiple unit nesting and transportation, and a portable hook and strap design for single unit nesting and transportation.

Additionally, as mentioned above, the side walls of the container operate as profile-stiffening walls and their corrugated shape provides additional structural stability.

Further, the side walls include overlapping corners. This allows the four walls to be molded and bonded at the corners for extra strength. Additionally, the walls may employ a male and female interlock. This structure may provide greater horizontal strength and abutting seams and may provide additional vertical strength.

Also, the side walls enter the base/hopper and are restrained by the top lip 240 of the hopper. This may help keep the side walls stiff and/or structurally sound and may constrain the side walls.

Additionally, one or more embodiments include four-piece side walls with a separate base. The side walls may thus be molded and transported easily and the base may be replaced if it becomes worn or broken.

Also, the container includes latched through the lid to secure the lid to the side walls.

Further, the container includes integrated venting and fumigating features. More specifically, in one or more embodiments there is sufficient space between the lid and the uppermost lip of the container to allow for a gaseous substance to both intrude and escape once the lid is securely fastened to the container. For example, this space may be about 4 square inches. While this space allows for a gaseous substance to both invade and escape the contents of the container, it is also small enough to prevent the intrusion of most insects. The fumigation venting areas are preferably evenly spread about the entire top rim of the container. Although the space for venting is not specifically shown, it may be embodied as a predetermined and designed gap between the lid and the top lip of the container. The venting gap is also preferably waterproof.

Also, the lid includes a number of lateral motion restraints to locate and position a container when it is stacked on another container. For example, the interior lateral motion restraint discussed above of the raised section in the middle of the container top.

Other features include the optional sight glass port in the side walls, the optional spigot port for liquid discharge, the optional tank insert, the optional liner insert, and the lid with the filling port and cap.

Also, in an alternative embodiment a container design with a flat bottom rather than a hopper bottom may be provided. Such a design may be useful, for example, for applications that remove bulk material from the top of the container rather than from a gravity-driven chute at the base. One example of such an application is a vacuum system. Further, such a container design with a flat hopper bottom on base may provide additional storage capacity.

In addition, the seed tender adaptor plate assembly allows a container to be easily adapted to existing seed tenders.

While particular elements, embodiments, and applications of the present invention have been shown and described, it is understood that the invention is not limited thereto because modifications may be made by those skilled in the art, particularly in light of the foregoing teaching. It is therefore contemplated by the appended claims to cover such modifications and incorporate those features which come within the spirit and scope of the invention.

The invention claimed is:

1. A bulk material container comprising:

container walls, wherein said container walls extend substantially vertically from a base to form an opening at their upper extent, wherein said opening describes a shape having a perimeter, wherein at least one container wall has a series of projections and recesses in an interior of said at least one container wall, wherein said at least one container wall includes a vertical stop configured to stop downward movement of said bulk material container, wherein said vertical stop is positioned in one of the recesses on an exterior of said at least one container wall, and wherein a bottom side of said vertical stop is configured to contact a top side of one of said projections of an identical bulk material container during stacking;

a container lid, wherein said container lid is disposed in said opening and supported by said upper extent of said container walls;

a lid frame located at least in substantial conforming relationship to said perimeter, wherein said lid frame provides structural reinforcement for said container lid, and wherein said lid frame is a separate element from said container lid; and a stiffening hoop installed around said perimeter of said container walls, wherein said stiffening hoop constrains the outward motion of said container walls.

2. The container of claim 1 wherein said lid frame is composed of a different material from said container lid.

3. The container of claim 2 wherein said container lid includes a structure to receive said lid frame.

4. A bulk material container comprising:

a plurality of container walls, wherein said container walls may be detached from each other and replaced, wherein at least one container wall has a series of projections and recesses in an interior of said at least one container wall, wherein said at least one container wall includes a vertical stop configured to stop downward movement of said bulk material container, wherein said vertical stop is positioned in one of the recesses on an exterior of said at least one container wall, wherein a bottom side of said vertical stop is configured to contact a top side of one of said projections of an identical bulk material container during stacking, and wherein said container walls include an upper lip proximal to their upper extent;

a container base, wherein said container based is adapted to receive said container walls, wherein said container base is detachable from said plurality of container walls;

a plurality of U-shaped portions that are positioned under said upper lip and joined together;

a container lid supported by an upper extent of said plurality of container walls; and a lid frame located at least in substantial conforming relationship to an upper perimeter of said container walls, wherein said lid frame provides structural reinforcement for said container lid, and wherein said lid frame is a separate element from said container lid.

5. The container of claim 4 wherein said plurality of container walls includes four container walls that assemble to form a rectilinear container.

6. The container of claim 4 wherein said container base includes a top lip.

7. The container of claim 6 wherein said container walls are placed inside said top lip of said container base to restrain the outward motion of the bottom edges of said container walls.

8. A bulk material container comprising:

a plurality of container walls, wherein said container walls may be detached from each other and replaced, wherein said container walls extend substantially vertically from a base to form an opening at their upper extent, wherein said opening describes a shape having a perimeter, wherein at least one container wall has a series of projections and recesses in an interior of said at least one container wall, wherein said at least one container wall includes a vertical stop configured to stop downward movement of said bulk material container, wherein said vertical stop is positioned in one of the recesses on an exterior of said at least one container wall, wherein a bottom side of said vertical stop is configured to contact a top side of one of said projections of an identical bulk material container during stacking;

a stiffening hoop installed around said perimeter of said container walls, wherein said stiffening hoop constrains the outward motion of said container walls a container lid supported by said upper extent of said plurality of container walls; and a lid frame located at least in substantial conforming relationship to said perimeter, wherein said lid frame provides structural reinforcement for said container lid, and wherein said lid frame is a separate element from said container lid.

9. The container of claim 8 wherein said container walls include an upper lip around their exterior perimeter.

10. The container of claim 9 wherein said stiffening hoop is installed under said upper lip.

11. The container of claim 8 wherein said stiffening hoop is a tube made of metal.

12. A system for stacking bulk material containers, said system comprising:

a first bulk material container having a container lid, wherein said lid includes a lid frame extending substantially around the perimeter of said lid and installed into structure in said lid; and a second bulk material container having a base, wherein said base includes a rigid structural element, wherein said container lid includes a fixed structure that cooperates with said rigid structural element to restrain the lateral motion of said second bulk material container relative to said lid;

wherein said first bulk material container includes container walls forming an opening at their upper extent, wherein said opening describes a shape having a perimeter, wherein at least one container wall has a series of projections and recesses in an interior of said at least one container wall, wherein said at least one container wall includes a vertical stop configured to stop downward movement of said bulk material container, wherein said vertical stop is positioned in one of the recesses on an exterior of said at least one container wall, wherein a bottom side of said vertical stop is configured to contact a top side of one of said projections of an identical bulk material container during stacking, wherein a stiffening hoop is installed around said perimeter of said container walls, and wherein said stiffening hoop constrains the outward motion of said container walls.

13. The system of claim 12 wherein said fixed structure of said container lid is at least one ridge positioned near the edge of said container lid.

14. The system of claim 12 wherein said rigid structural element of said second bulk material container base is the exterior of a foot of said base.

15. The system of claim 14 wherein said fixed structure of said container lid further includes at least one ridge positioned transversely substantially across said container lid.

16. The container of claim 1 wherein said vertical stop is configured to reduce friction between said bulk material container and said identical bulk material container during stacking.

17. The container of claim 1 wherein said series of projections and recesses in said interior of said at least one container wall are configured to guide said bulk material container into said identical bulk material container during stacking.

18. The container of claim 1 wherein said vertical stop is configured so that a bottom of said bulk material container does not contact a bottom of said identical bulk material container during stacking.

19. The container of claim 1 wherein said container lid has protruding exterior lateral motion restraints and protruding interior lateral motion restraints that are configured to receive an exterior base of said identical bulk material container during stacking.

20. The container of claim 1 wherein said base is physically connected to said container walls, and wherein said base includes a hopper and forklift apertures.

* * * * *